US006749053B2

(12) United States Patent
Ikuta

(10) Patent No.: US 6,749,053 B2
(45) Date of Patent: Jun. 15, 2004

(54) BILL HANDLING MACHINE

(75) Inventor: Yoshiaki Ikuta, Himeji (JP)

(73) Assignee: Glory Kogyo Kabushiki Kaisha, Hyogo-ken (JP)

( * ) Notice: Subject to any disclaimer, the term of this patent is extended or adjusted under 35 U.S.C. 154(b) by 38 days.

(21) Appl. No.: 09/789,801

(22) Filed: Feb. 22, 2001

(65) Prior Publication Data

US 2001/0015309 A1 Aug. 23, 2001

(30) Foreign Application Priority Data

Feb. 22, 2000 (JP) ..... 2000-044188
Feb. 22, 2000 (JP) ..... 2000-044202

(51) Int. Cl.[7] ..... G07F 7/04; G07F 9/10

(52) U.S. Cl. ..... 194/206; 194/350; 109/66; 209/534

(58) Field of Search ..... 194/206, 344, 194/350, 351; 109/45, 49, 55, 58, 58.5, 64, 66, 68, 98; 232/1 D, 43.1, 43.2, 62; 235/379, 380; 209/534; 220/476, 478, 479; 221/154

(56) References Cited

U.S. PATENT DOCUMENTS 1,949,283 A * 2/1934 Murtaugh, Jr. ..... 109/24.1
2,030,313 A * 2/1936 Murtaugh, Jr. ..... 101/71
4,447,714 A * 5/1984 Lundblad ..... 194/206
4,459,052 A * 7/1984 Lundblad ..... 221/198
4,628,192 A * 12/1986 Suzuki ..... 235/1 R
4,662,621 A * 5/1987 Lundblad ..... 194/350
4,883,183 A * 11/1989 Kimura et al. ..... 194/206
5,301,618 A * 4/1994 Abendschein et al. ..... 109/55
5,564,545 A * 10/1996 Suzuki ..... 194/206
5,662,202 A * 9/1997 Suris ..... 194/206
5,730,271 A * 3/1998 Buchman et al. ..... 194/206
6,199,856 B1 * 3/2001 Clauser et al. ..... 271/180
6,357,598 B1 * 3/2002 Kimura et al. ..... 209/534
2002/0011393 A1 * 1/2002 Siemens ..... 194/215

FOREIGN PATENT DOCUMENTS

JP 2-150986 A * 6/1990 ..... G07D/9/00
JP 2-166590 A * 6/1990 ..... G07D/9/00
JP 4-275695 A * 10/1992 ..... G07D/3/00

* cited by examiner

*Primary Examiner*—Donald P Walsh
*Assistant Examiner*—Mark J Beauchaine
(74) *Attorney, Agent, or Firm*—Wenderoth, Lind & Ponack L.L.P.

(57) ABSTRACT

The invention includes a bill processing unit into which a bill is fed and in which the bill is examined. The bill that has been examined and approved by the bill processing unit is received and stored by a storage unit. The bill processing unit and the storage unit are separated by a partition. A passage opening is formed in the partition through which the bill passes. According to the invention, even if the bill processing unit is destroyed, the bills in the storage unit may not be stolen. That is, protection against theft may be improved.

14 Claims, 15 Drawing Sheets

BILL HANDLING MACHINE

BACKGROUND OF THE INVENTION

1. Field of the Invention

This invention relates to a bill handling machine and, in particular, to a bill handling machine that can store a bill, which has been deposited through a bill deposit/withdrawal unit, in a storage unit that is separated from the bill deposit/withdrawal unit.

2. Description of the Related Art

There is known a machine including: a bill deposit/withdrawal unit that can conduct a bill depositing process and a bill refunding process, and a storage unit (safe unit) that can store bills that have been deposited through the bill deposit/withdrawal unit, from Japanese Patent Laid-Open Publication No. 10-329975. In the machine, the bill deposit/withdrawal unit and the storage unit are separated, so that protection against theft may be improved because there are no bills in the bill deposit/withdrawal unit.

In addition, in the machine, the bill deposit/withdrawal unit and the storage unit are disposed apart from each other. The bill deposit/withdrawal unit and the storage unit are connected with each other via an air tube. The air tube is adapted to transfer the bills in both directions by making use of the Venturi effect.

That is, the bills are transferred through the air tube by air pressure. Thus, the above machine has to have a source of pressured air, some actuators, some pressure-adjusting means and/or some other incidental instruments. Therefore, the machine may be extremely complicated and very costly. In addition, the air tube may become jammed with the bills because the bills are transferred together with the pressured air. Furthermore, it is difficult to surely deliver the bills into the air tube. In other words, a mechanism for delivering the bills into the air tube is unavoidably complicated.

In addition, there is known an automatic bill refunding machine that can refund a plurality of kinds of bills, as taught in Japanese Patent No. 2674899. The number of safes included in the machine varies depending on the number of kinds of bills that are ready for refunding.

In detail, the machine includes one or more box-like refunding modules that can be removably fitted in a main body of the machine and that can be piled up. The box-like refunding module has: a horizontal safe, a feeding-out part that can feed out a bill from an end part of the safe, a first passage through which the fed bill is transferred, and a second passage that connects with the first passage and that can also transfer a bill received at another position. Thus, the number of safes may be adjusted by changing the number of stacked refunding modules.

Considering the world currency situation, many kinds of bills are circulated in one country. In addition, in some countries in Europe or the like, bills of adjacent other countries are also widely used. Thus, in such a country, a financial institution such as a bank has to deal with many kinds of bills. On the contrary, there are also many cases wherein the machine that can deal with only one kind of bill is sufficient.

The above conventional machine has been developed only for refunding the bills. That is, the machine is not applicable to a circulating-type bill depositing and dispensing machine wherein the bills that have been deposited can be refunded again. In other words, there is still no circulating-type bill depositing and dispensing machine that can suitably keep up with an increase or decrease in the number of kinds of bills.

SUMMARY OF THE INVENTION

Therefore, the object of this invention is to provide a bill handling machine comprising a bill processing unit that can be operated by customers and a storage unit that can store bills that have been deposited. The bill processing unit and the storage unit are separated, and the bills are surely transferred without complicated mechanisms and with improved protection against theft.

In addition, the object of this invention is to provide a circulating-type bill depositing and dispensing machine that can effectively function in various ways, for example when many kinds of bills have to be dealt with, when only small kinds of bills (in particular, only one kind of bill) have to be dealt with, or when a plurality of kinds of stored bills are allowed to intermingle with each other.

Thus, this invention is characterized by the following features. That is, this invention is a bill handling machine comprising: a bill processing unit into which a bill is fed and in which the bill is discriminated; a storage unit that can receive and store the bill that has been discriminated and approved by the bill processing unit; a partition that separates the bill processing unit and the storage unit; and a passage opening formed in the partition through which the bill passes.

According to these features, the bill processing unit and the storage unit are separated by the partition, and the bill processing unit and the storage unit are connected with each other only via the passage opening through which the bill can pass. Thus, the bills stored in the storage unit may be stored safely. That is, the bills are prevented from being stolen even if the bill processing unit is destroyed.

In addition, since the bills are transferred through the passage opening formed in the partition, a distance of transfer to the storage unit may be much shorter. Thus, the possibility that a jam the passage with the bills will occur may be significantly reduced. Furthermore, since the passage structure does not require any special mechanisms, the machine is advantageous in cost.

Preferably, the bill processing unit may have a depositing part into which bills are inserted. In addition, the bill processing unit may have a refunding part from which the bill that has been discriminated and not approved is paid back. In addition, the bill processing unit may have a temporary storing part in which the bill can be temporarily stored.

For example, the partition may be a door of a safe that can open and close, and the bill processing unit can be provided on the door in such a manner that the bill processing unit can open and close with respect to the door. The storage unit can be arranged in the safe, the passage opening can be formed in the door, and a bill passage of the bill processing unit and the passage opening can be aligned with each other when the bill processing unit closes with respect to the door. The door can be operated to open and close when the bill processing unit opens with respect to the door.

Alternatively, the partition can be a wall of a vault, the bill processing unit can be provided on an outside of the wall, the storage unit can be arranged in the vault, the passage opening can be formed in the wall, and a bill passage of the bill processing unit and a bill passage of the storage unit can be coupled to each other via the passage opening.

Alternatively, the partition can be a wall between a lobby room and a second room, the bill processing unit can be provided on a lobby-room side oft he wall, the storage unit can be arranged in the second room, the passage opening can be formed in the wall, and a bill passage of the bill processing unit and a bill passage of the storage unit can be coupled to each other via the passage opening.

In the above cases, the bill handling machine may be adapted to function as a circulatory-type bill depositing and dispensing machine.

Alternatively, this invention is characterized by the following features. That is, this invention is a circulating-type bill depositing and dispensing machine comprising: a bill processing unit that can conduct a bill depositing process and a bill dispensing process; a storage unit that can receive and store bills that have been deposited through the bill processing unit and that can feed out the bills; and a storage cassette that can receive and store the bill that has been fed out from the storage unit and that can feed out the bill. The storage cassette is arranged behind the storage unit in a column-like manner, and a second storage cassette, which can receive and store the bill that has been fed out from the storage cassette and which can feed out the bill, can be serially arranged behind the storage cassette in a column-like manner.

According to these features, the number of storage cassettes may be easily changed. That is, it may be easy to keep up with an increase or a decrease in the number of kinds of stored bills and/or an increase or a decrease in the amount of stored bills.

For example, the storage cassette has: a storage bin arranged therein; a depositing passage through which the bill is sent to the storage bin; and a dispensing passage through which the bill is fed out from the storage bin. The depositing passage and the dispensing passage can connect with a depositing passage and a dispensing passage of the serially arranged second storage cassette.

In this embodiment, preferably, the storage cassette has two storage bins that have the same structure and are vertically arranged. The bill is adapted to be selectively sent from the depositing passage to the respective two storage bins, and the bill is adapted to be selectively fed out from the respective two storage bins to the dispensing passage.

In addition, preferably, the bill is adapted to be sent to the storage bin through an upper portion of the storage bin and fed out from the storage bin through a lower portion of the storage bin. The storage bin has: a feeding-out unit arranged at a lower portion of the storage bin, which can feed out the bill pressed thereto; a stage that is vertically movable in the storage bin and that can receive and accumulate bills sent through the upper portion of the storage bin thereon; a pressing body that can press the bills accumulated on the stage to press a lowest bill of the bills to the feeding-out unit, the pressing body being entirely or partly made of a magnetic material; and an electromagnet arranged at an upper portion of the storage bin for sticking to and holding the pressing body when the stage is moved up in order to allow the bills to be sent onto the stage. The electromagnet is adapted to release the pressing body in such a manner that the pressing body falls on and holds the accumulated bills when the accumulated bills are fed out or the storage cassette is pulled out.

In addition, preferably, the storage cassette has an outside shell and an inside shell that is fitted in the outside shell. The depositing passage and the dispensing passage are arranged in the outside shell, the storage bin is arranged in the inside shell, and the inside shell is removable from the outside shell and is portable.

DETAILED DESCRIPTION OF THE INVENTION

Embodiments of the invention will now be explained in more detail with reference to the drawings.

Figure 1:
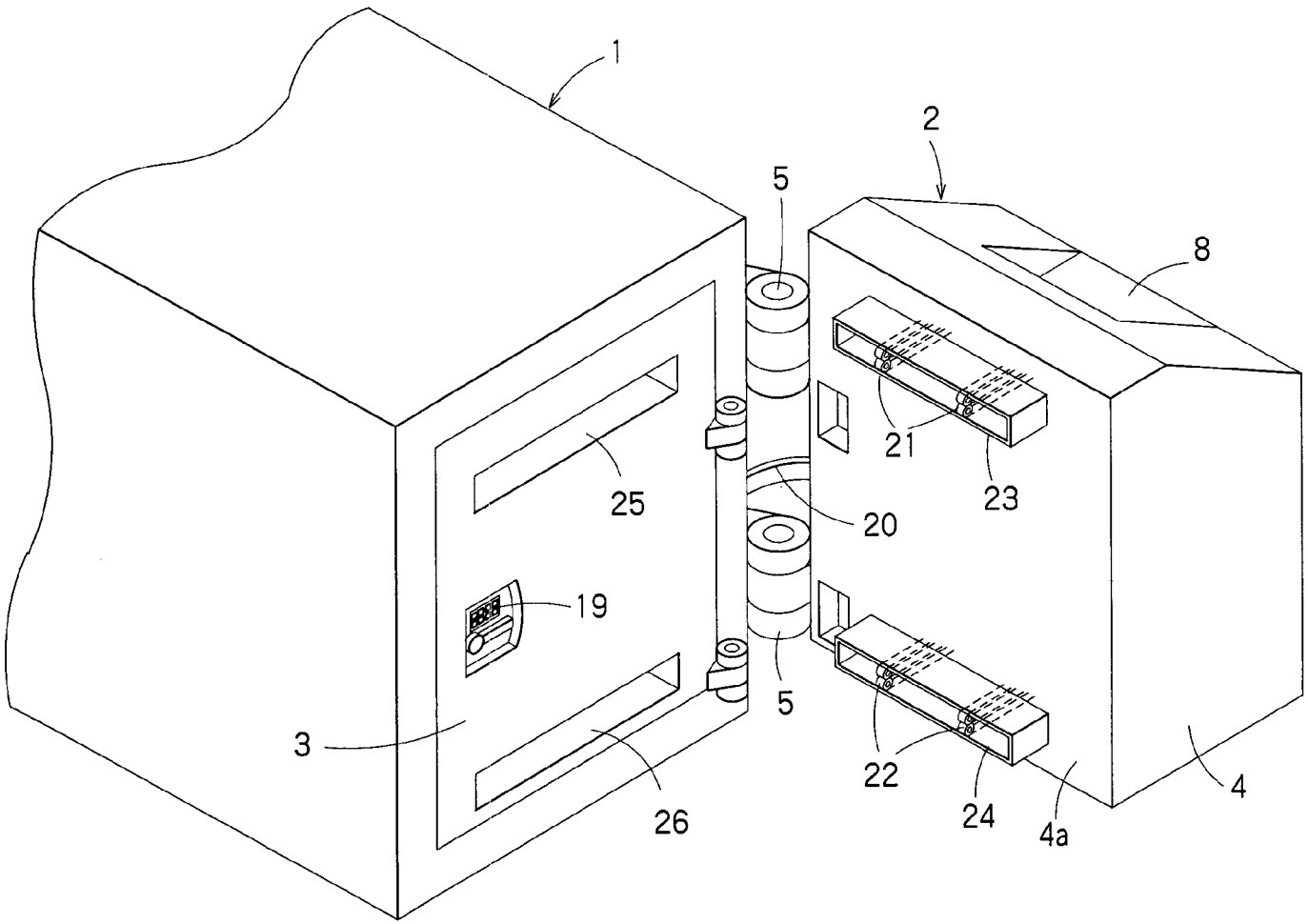
FIG. 1 is a schematic perspective view of a bill processing unit (in its open state) of a first embodiment, wherein the invention is applied to a safe.
Figure 2:
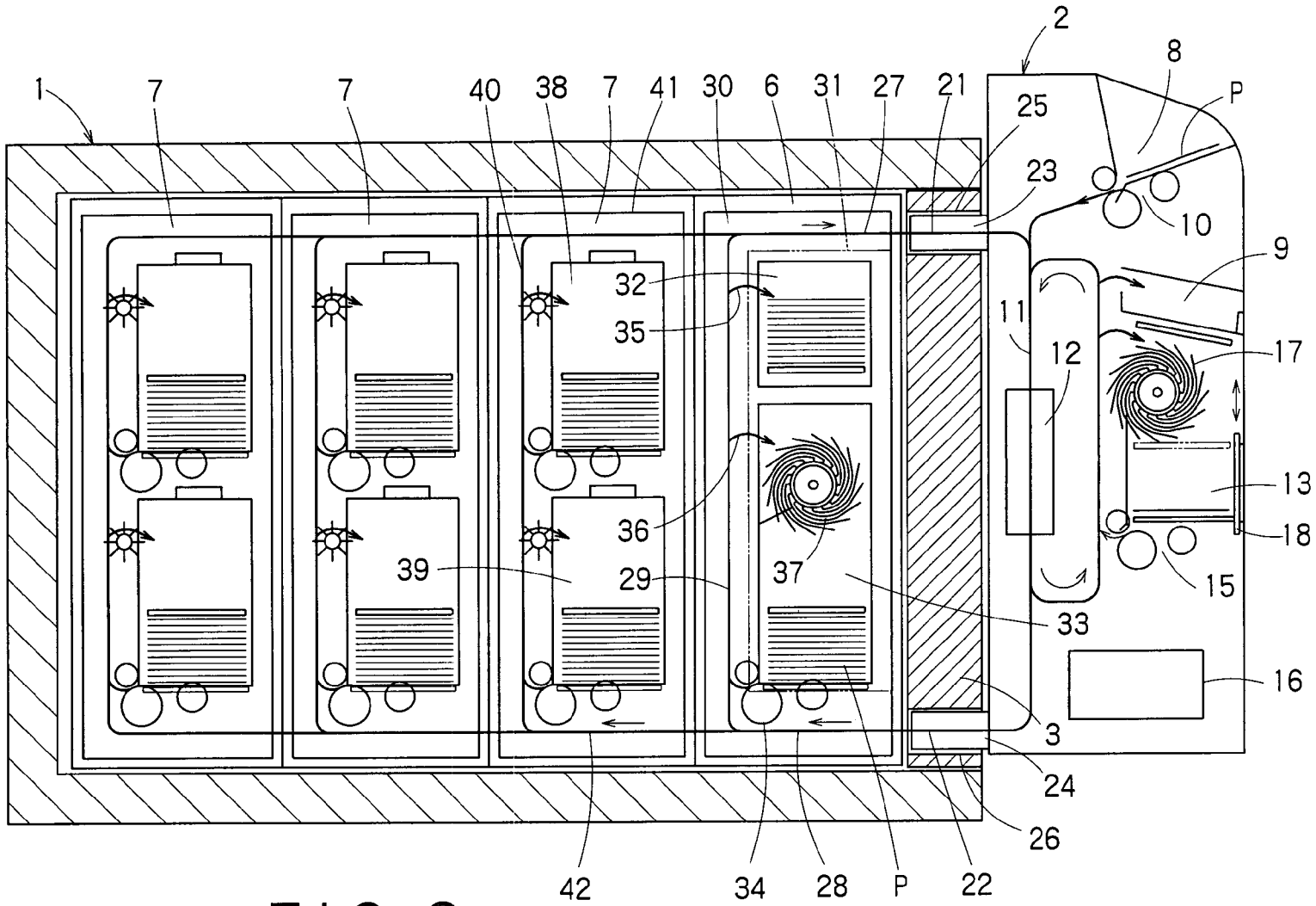
FIG. 2 is a schematic sectional view of the first embodiment shown in FIG. 1 in its operational state.

FIGS. 1 and 2 show a first embodiment wherein the invention is applied to a safe. As shown in FIGS. 1 and 2, the first embodiment mainly consists of a safe 1 and a bill processing unit 2.

In the embodiment, a door 3 is provided in a door side of the safe 1. The door 3 can open and close with respect to the door side of the safe 1. An outer case 4 defining an outer periphery of the bill processing unit 2 is mounted to the door side of the safe 1 via hinges 5, 5. Thus, the outer case 4 can also open and close with respect to the door side of the safe 1. When the outer case 4 closes with respect to the door side, a backside plate 4*a* of the outer case 4 is arranged to conceal the door 3 of the safe 1. The door 3 thus forms a partition separating the safe 1 from the bill processing unit 2.

In the safe 1, as shown in FIG. 2, a mixed bank note cassette 6 is disposed near to the door 3. Behind the mixed bank note cassette 6, at least one (three in FIG. 2) of the bank note cassettes 7 are disposed corresponding to the number of kinds of bills. Then, the mixed bank note cassette 6 and the bank note cassettes 7 form a storage unit. Thus, the bill handling machine of the embodiment is a circulating-type bill depositing and dispensing machine wherein the bills that have been deposited can be refunded again.

As shown in FIG. 2, the bill processing unit 2 has: a depositing portion 8 provided at a front upper portion of the outer case 4, into which the bills P are inserted; a refunding (dispersing) portion 9 (rejection port) provided just below the depositing portion 8 in the front surface of the outer case 4; a longitudinal looped transfer passage 11 arranged in the outer case 4 for transferring the bills that are inserted through the depositing portion 8 and fed out by a feeding mechanism 10 one by one; a discriminating component 12 arranged along the transfer passage 11 for examining the various kinds of bills and/or approving the bills; a temporary storing section 13 for temporarily storing the bills that have been discriminated and approved by the discriminating (examining) component 12; and feeding mechanism 15 arranged at a lower portion of the temporary storing section 13 for feeding out the stored bills P and sending them to the mixed bank note cassette 6 in the safe 1. Flappers are disposed at divergence junctions between the transfer passage 11 and the respective components as usual. Operations of the respective components and the flappers are controlled by a controller 16.

In addition, in FIG. 2, an impeller 17 is provided for smoothly accumulating the bills P transferred to the temporary storing section 13. A shutter 18 can open when the bills are paid back (i.e. distributed). As shown in FIG. 1, a key 19 is provided to open the door 3 of the safe 1. A flexible cable 20 electrically connects the inside of the safe 1 and the bill processing unit 2.

Passage portions 23, 24 including transfer passages 21, 22 respectively branched from an upper portion and a lower portion of the transfer passage 11 protrude from an upper portion and a lower portion of the backside plate 4a of the outer case 4, respectively. As shown in FIG. 1, each of the protruding passage portions 23, 24 has a rectangular shape having a width larger than the width of the bills. The door 3 of the safe 1 has passage openings 25, 26 into which the protruding passage portions 23, 24 can be fitted substantially tightly, respectively. That is, each of the passage openings 25, 26 also has a rectangular shape slightly larger than the protruding passage portion 23 or 24. When the outer case 4 closes with respect to the door side of the safe 1, the transfer passages 21, 22 of the passage portions 23, 24 are aligned with and connect with transfer passages 27, 28 formed at an upper portion and a lower portion of the mixed bank note cassette 6, respectively.

The mixed bank note cassette 6 and the bank note cassettes 7, 7, 7 are conveyed into and from the inside of the safe 1 while the door 3 is open with respect to the door side of the safe 1. When these cassettes are set at respective predetermined positions in the safe 1, these cassettes are connected to one or more driving sources for the transfer of the bills and for operations of the respective components. For example, driving force is transmitted from the driving sources to the components via one or more moving belts.

The mixed bank note cassette 6 has a double structure. That is, the cassette 6 has an outside (outer) shell 30 and an inside (inner) shell 31 that is fitted in the outside shell 30. The transfer passages 27, 28 and a longitudinal transfer passage 29 connecting the transfer passages 27, 28 are arranged in the outer shell 30. An upper storage bin 32 is formed at an upper portion in the inside shell 31. A lower storage bin 33 is formed at a lower portion of the inside shell 31. A feeding mechanism 34, which can feed out the bills P one by one, is arranged at a base portion of the lower storage bin 33. In addition, delivery passages 35, 36 are branched from the vertical longitudinal passage 29 in the outside shell 30 in order to send the bills to the respective storage bins 32, 33. An impeller 37 smoothly accumulates and stores the bills P. In the mixed bank note cassette 6, the inside shell 31 can be removed from the outside shell 30. Thus, only the inside shell 31 can be conveyed to an accounting office or the like.

Figure 3:
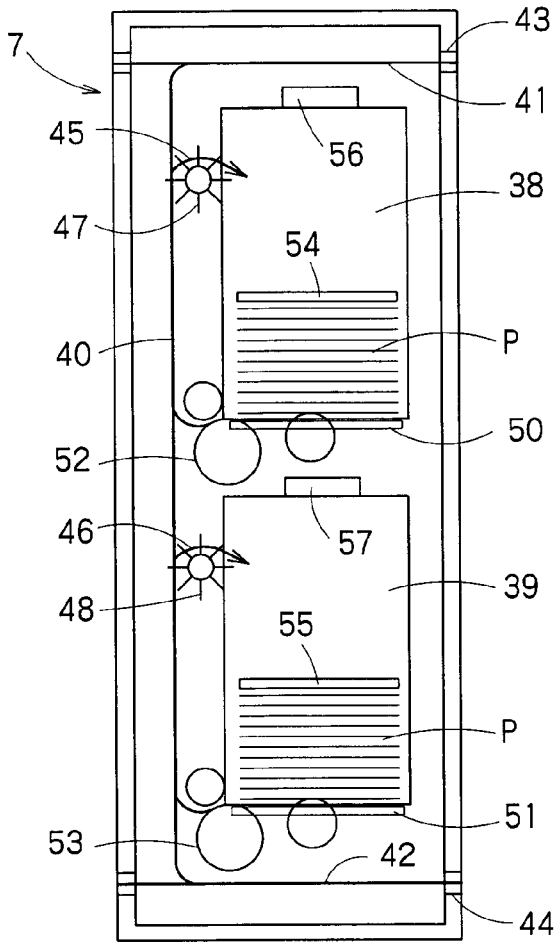
FIG. 3 is an enlarged sectional view of a bank note cassette shown in FIG. 2.

The bank note cassettes 7, 7, 7 have the same structure. FIG. 3 shows an enlarged sectional view of the structure. As shown in FIG. 3, an upper storage bin 38 is formed at an upper portion of the cassette 7. A lower storage bin 39 is formed at a lower portion in the cassette 7. The upper storage bin 38 is disposed just above the lower storage bin 39. A vertical longitudinal passage 40 is arranged along and near to a backside (left in FIG. 3 ) wall of the cassette 7. An upper portion and a lower portion of the transfer passage 40 are connected to an upper transfer passage 41 and a lower transfer passage 42, respectively. The upper transfer passage 41 connects with the transfer passage 27 of the mixed bank note cassette 6 via a passage portion 43, and connects with another upper transfer passage 41 of an adjacent (rear) bank note cassette 7. The lower transfer passage 42 connects with the transfer passage 28 of the mixed bank note cassette 6 via a passage portion 44, and connects with another lower transfer passage 42 of the adjacent (rear) bank note cassette 7. As shown in FIG. 2, in the rearmost (leftmost) bank note cassette 7, the upper and lower transfer passages 41 and 42 connect only with the transfer passages 41 and 42 of the right adjacent bank note cassette 7.

A branched path 45 is branched from the vertical transfer passage 40 in order to send the bills into the storage bin 38. An impeller 47 is disposed along the branched path 45 in order to send the bills more smoothly. Similarly, a branched path 46 is branched from the vertical transfer passage 40 in order to send the bills into the storage bin 39. An impeller 48 is disposed along the branched path 46 in order to send the bills more smoothly.

A receiving plate 50 (stage) is vertically movable in the storage bin 38. A feeding-out mechanism 52 that can feed out the bills one by one is arranged at a base portion of the storage bin 38. Thus, the bills in bin 38 can be sent to the bill processing unit 2 via the transfer passages 40 and 41. Similarly, a receiving plate 51 (stage) is vertically movable in the storage bin 39. A feeding-out mechanism 53 that can feed out the bills one by one is arranged at a base portion of the storage bin 39. Thus, the bills in bin 39 can be sent to the bill processing unit 2 via the transfer passages 40 and 41.

A pressing plate 54 (pressing body) that has been entirely or partly made of a magnetic material is placed in the storage bin 38. An electromagnet 56 is mounted on an upper wall of the storage bin 38. When the bills P accumulated on the receiving plate 50 are fed out, magnetic force created by the electromagnet 56 is stopped. Thus, the pressing plate 54 is allowed to fall on the accumulated bills P and press them down because of its own weight. Thus, suitable frictional force is generated between the lowermost bill P and the feeding-out mechanism 52. On the other hand, when the bills P are received into the storage bin 38, the receiving plate 50 is lifted up and the electromagnet 56 lifts the pressing plate 54 in order to allow the bills P to be sent onto the receiving plate 50. Similarly, a pressing plate 55 (pressing body) that has been entirely or partly made of a magnetic material is placed in the storage bin 39. An electromagnet 57 is mounted on an upper wall of the storage bin 39. When the bills P accumulated on the receiving plate 51 are fed out, magnetic force created by the electromagnet 57 is stopped. Thus, the pressing plate 55 is allowed to fall on the accumulated bills P and press them down because of its own weight. Thus, suitable frictional force is generated between the lowermost bill P and the feeding-out mechanism 53. On the other hand, when the bills P are received into the storage bin 39, the receiving plate 51 is lifted up and the electromagnet 57 lifts the pressing plate 55 in order to allow the bills P to be sent onto the receiving plate 51.

Then, an operation of the above embodiment is explained.

When one or more bills P are deposited, the bills P to be deposited are inserted into the depositing portion 8 of the bill processing unit 2. After a predetermined depositing instruction is given, the feeding mechanism 10 operates to feed (take in) the bills one by one. The bills are transferred through the transfer passage 11, and examined by the discriminating (examining) component 12 as to the denomination, whether the bill is true or phony, and whether the bill is fit or unfit. If a bill is judged to be a normal bill, the bill is sent to the temporary storing section 13. If a bill is judged to be unfit or counterfeit, that is, if the bill is not normal, the bill is sent back to the refunding portion 9 (rejection port).

If the bills are to be stored and classified according to kind, the bills are sent to the respective storage bins 38 and 39, each corresponding to a kind of bill.

Figures 4A, 4B, 4C:
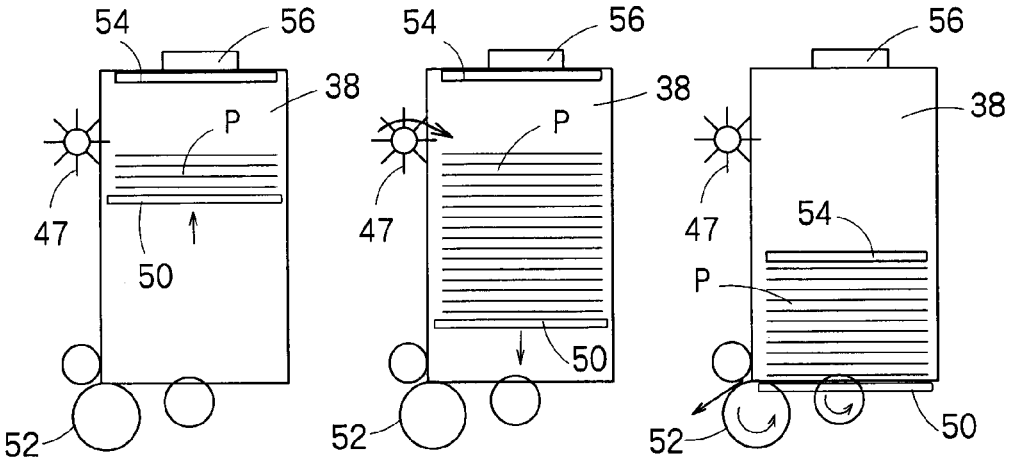
FIGS. 4A to 4C are schematic views for explaining an operation of a storage bin of the bank note cassette shown in FIG. 3.

When one or more bills P are paid out, according to an instructed amount of money, a corresponding number of bills P are fed out from the storage bins 38 and 39 in the bank note cassettes 7, respectively. In this case, as shown in FIGS. 4A to 4C, magnetic force from the electromagnet 56 when in a state shown in FIG. 4A or FIG. 4B is stopped wherein the storage bin 38 stores the bills to be fed out. Thus, the pressing plate 54 falls on the accumulated bills and presses them down because of its own weight. Then, the receiving plate 50 is moved down to the lowest position (FIG. 4C), and the lowermost bill P is pressed to the feeding-out mechanism 52 to be fed out.

The fed bills are sent to the bill processing unit 2 via the transfer passages 40 and 41, the transfer passage 27 of the mixed bank note cassette 6 and the transfer passage 21 of the passage portion 23. Then, the bills are examined by the discriminating (examining) component 12, and paid back to the refunding (dispersing) portion 9.

Figure 5:
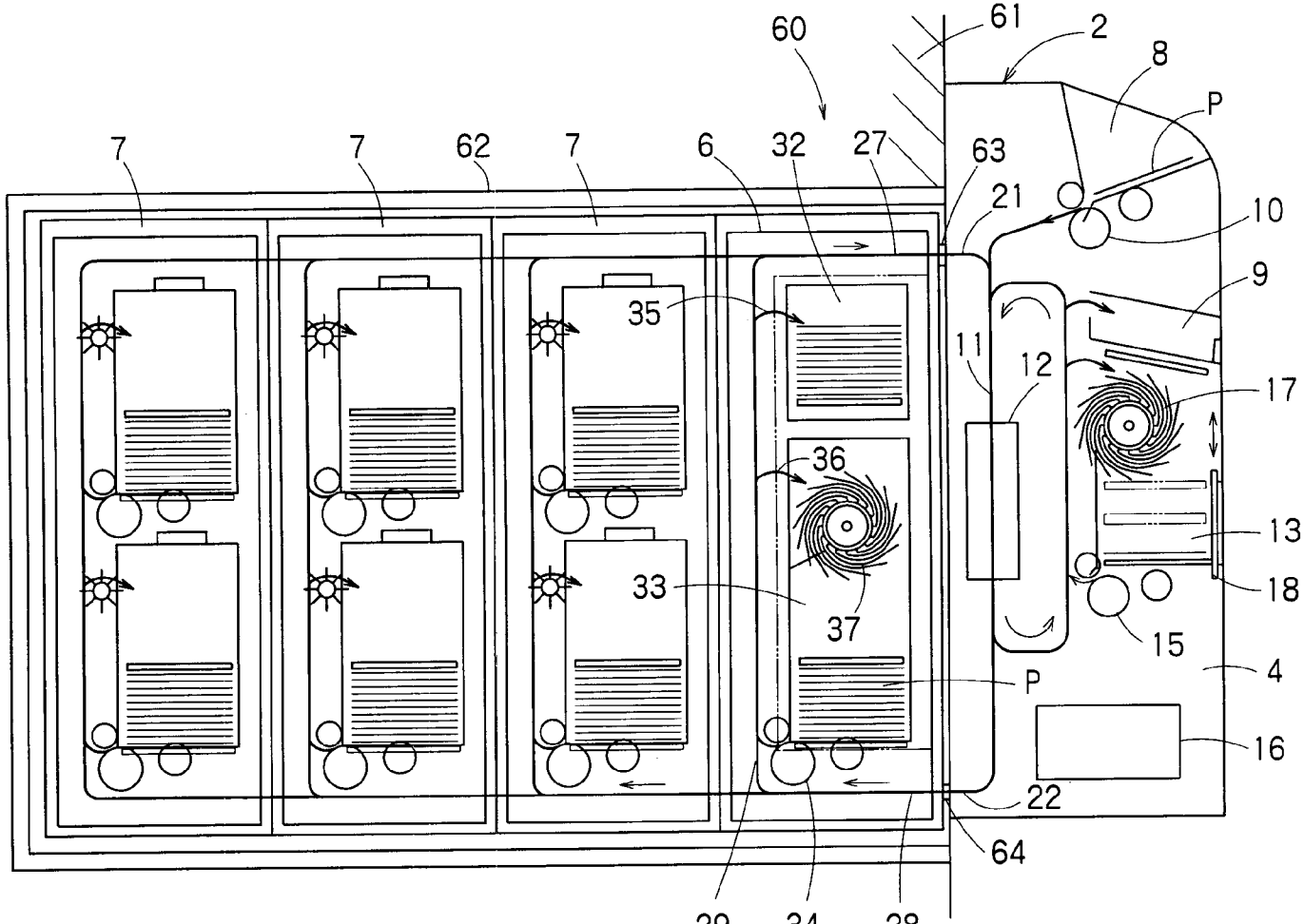
FIG. 5 is a schematic sectional view of a second embodiment wherein the invention is applied to a vault, in its operational state.

FIG. 5 is a schematic sectional view of a second embodiment, wherein the invention is applied to a vault 60. As shown in FIG. 5, a partition 61 separates the vault 60 from an outside area. Only managers can enter the vault 60. A backside wall of an outer case 4 of a bill processing unit 2 is closely fixed to an outside surface of the partition 61. A mixed bank note cassette 6 and bank note cassettes 7, 7, 7 are disposed in a frame 62 (vault 60) built in an inside area with respect to the partition 61. The mixed bank note cassette 6 and the bank note cassettes 7, 7, 7 form a storage unit. Similar to the safe 1, the bills P can pass between the bill processing unit 2 and the mixed bank note cassette 6, through passage openings 63 and 64 formed in the partition 61.

Each component of the embodiment shown in FIG. 5 is substantially the same as that shown in FIG. 2. Thus, the same numeral references correspond to the same components as the embodiment shown in FIG. 2. The explanation of the same structures and components is not repeated. In the embodiment shown in FIG. 5, the bills P are transferred substantially similarly to the embodiment shown in FIG. 2.

Figure 6:
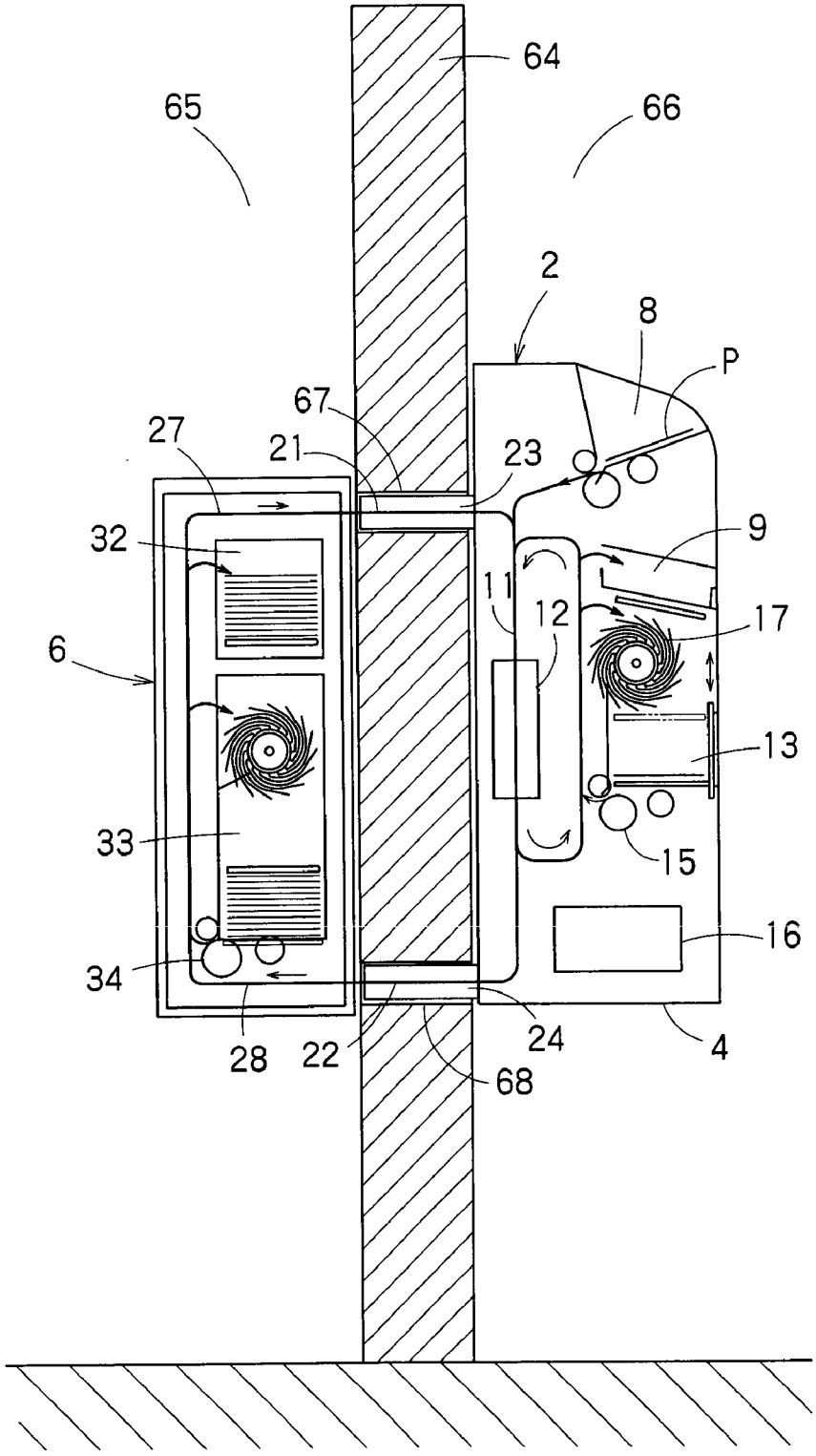
FIG. 6 is a schematic sectional view of a third embodiment wherein the invention is applied to a lobby-room, in its operational state.

FIG. 6 is a schematic sectional view of a third embodiment wherein the invention is applied to a lobby-room of a bank, a hotel or the like. As shown in FIG. 6, a partition 64 separates the lobby-room 66 from another second room 65. A mixed bank note cassette 6 that forms a storage unit is closely fixed to a second-room surface of the partition 64. An outer case 4 of a bill processing unit 2 is closely fixed to a lobby-room surface of the partition 64. Similar to the safe 1, the bills P can pass between the bill processing unit 2 and the mixed bank note cassette 6, through passage openings 67 and 68 formed in the partition 64.

Each component of the embodiment shown in FIG. 6 is substantially the same as that shown in FIG. 2. Thus, the same numeral references correspond to the same components as the embodiment shown in FIG. 2. The explanation of the same structures and components is not repeated.

When one or more bills P are deposited, the bills P to be deposited are inserted into the depositing portion 8 of the bill processing unit 2. After a predetermined depositing instruction is given, the feeding mechanism 10 operates to feed out the bills one by one. The bills are transferred through the transfer passage 11, and discriminated by the discriminating (examining) component 12 as to the denomination, whether the bill is true or phony, and whether the bill is fit or unfit. If a bill is judged to be genuine, the bill is sent to the temporary storing section 13. If a bill is judged to be unfit or counterfeit, that is, if the bill is not discriminated normal, the bill is sent back to the refunding portion 9 (rejection port).

If the bills are received in the temporary storing section 13 and are approved, that is, if an approval instruction is given, the bills are fed out from the temporary storing section 13 by the feeding mechanism 15, and sent to the storage bin 33, via the transfer passages 11 and 12, the transfer passages 28 and 29 of the mixed bank note cassette 6, and the branched path 36. When the storage bin 33 becomes full, the machine is generally stopped. Alternatively, the bills stored in the storage bin 33 may be fed out by the feeding-out mechanism 34, and sent to the upper storage bin 32.

As shown in FIG. 6, in the case of using only the mixed bank note cassette 6 as the storage unit, it is preferable that the type of each bill is stored by a memory (not shown). Thus, the bills may be used for refunding.

Figure 7:
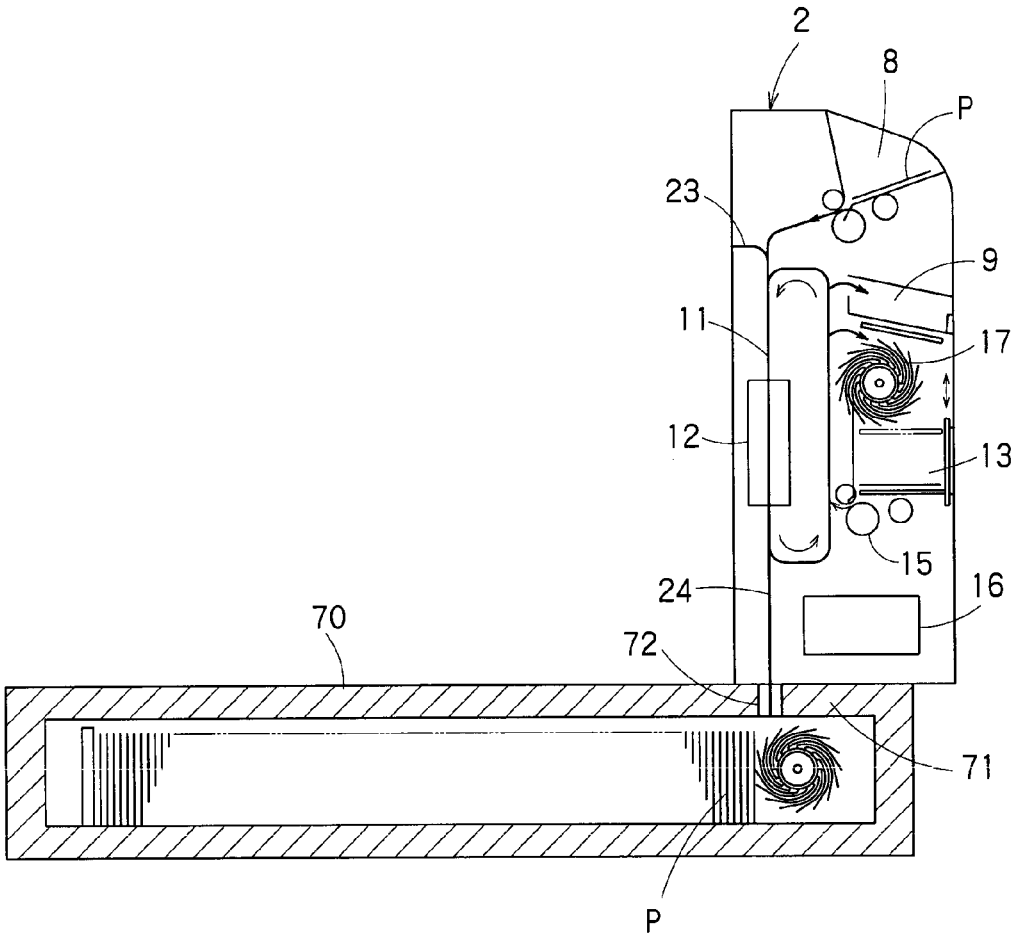
FIG. 7 is a schematic sectional view of a fourth embodiment wherein the invention is applied to a horizontal safe, in its operational state.

In the above embodiments, the bills are sent to the storage bin through the upper portion thereof and are fed out therefrom through the base lower portion thereof However, as seen from a fourth embodiment shown in FIG. 7, if it is not necessary to feed out the bills, the storage unit may be formed by a horizontal storing box 70. Then, the bills P may be stored as standing. In this case, if the storage box 70 has a safe structure and if a partition 71 forms a wall thereof, this invention is applicable to the storage box 70 by forming a passage opening 72 in the partition 71.

The bill processing unit 2 shown in FIG. 7 is substantially the same as that shown in FIG. 2. Thus, the same numeral references correspond to the same components as the embodiment shown in FIG. 2. The explanation of the same structures and components is not repeated.

Then, a fifth embodiment of the invention is explained with reference to FIGS. 8 to 10.

Figure 8:
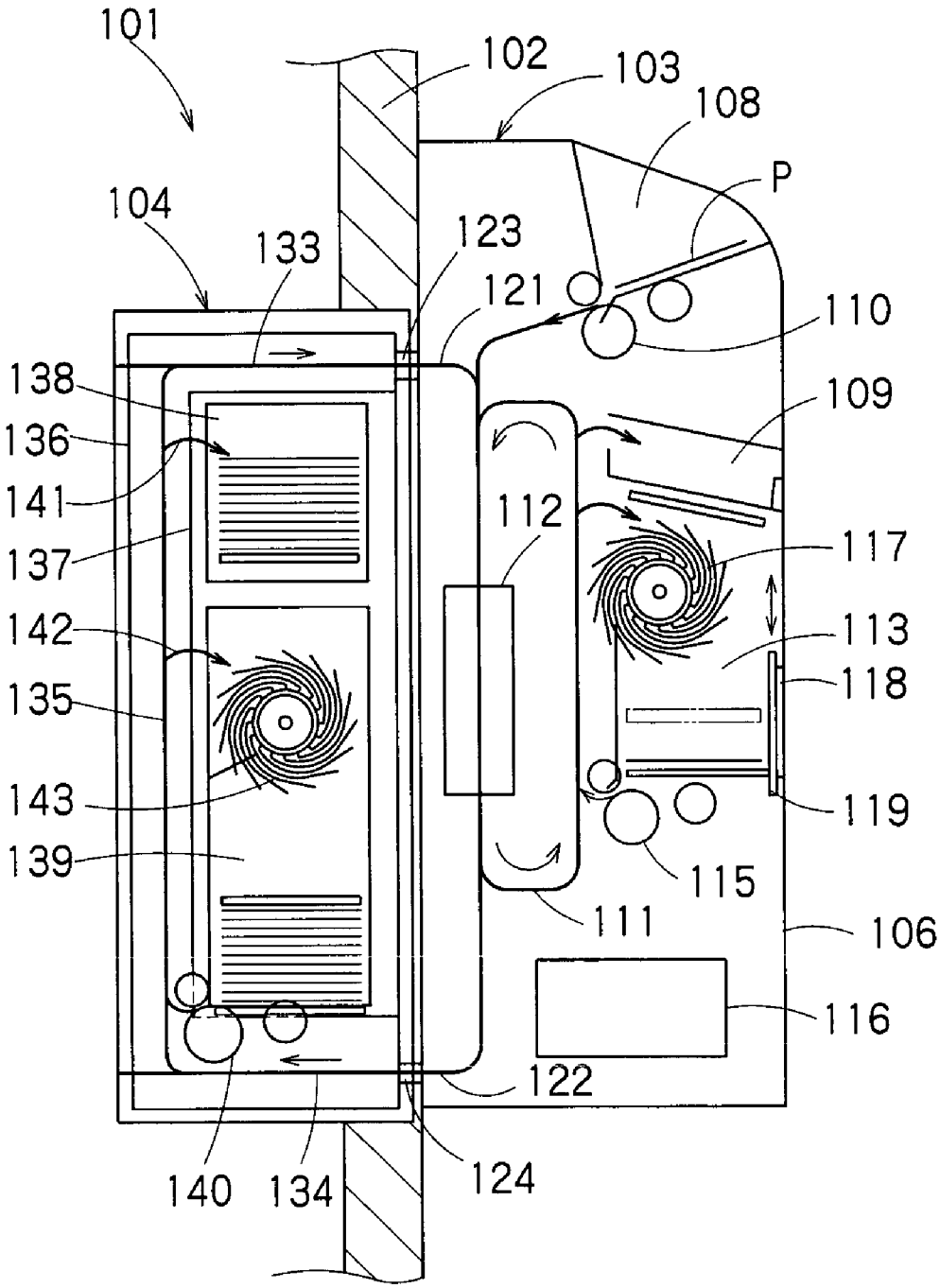
FIG. 8 is a schematic sectional view of a fifth embodiment.

FIG. 8 shows a case wherein only one mixed bank note cassette 104 is used as a storage unit. FIG. 9 shows a case wherein one bank note cassette 105 is arranged behind the mixed bank note cassette 104 in a column-like manner. FIG.

10 shows a case wherein three bank note cassettes 105 are serially arranged behind the mixed bank note cassette 104 in a column-like manner. The number of serially arranged bank note cassettes 105 is variable depending on the number of kinds of bills and/or the amount of bills.

Figure 9:
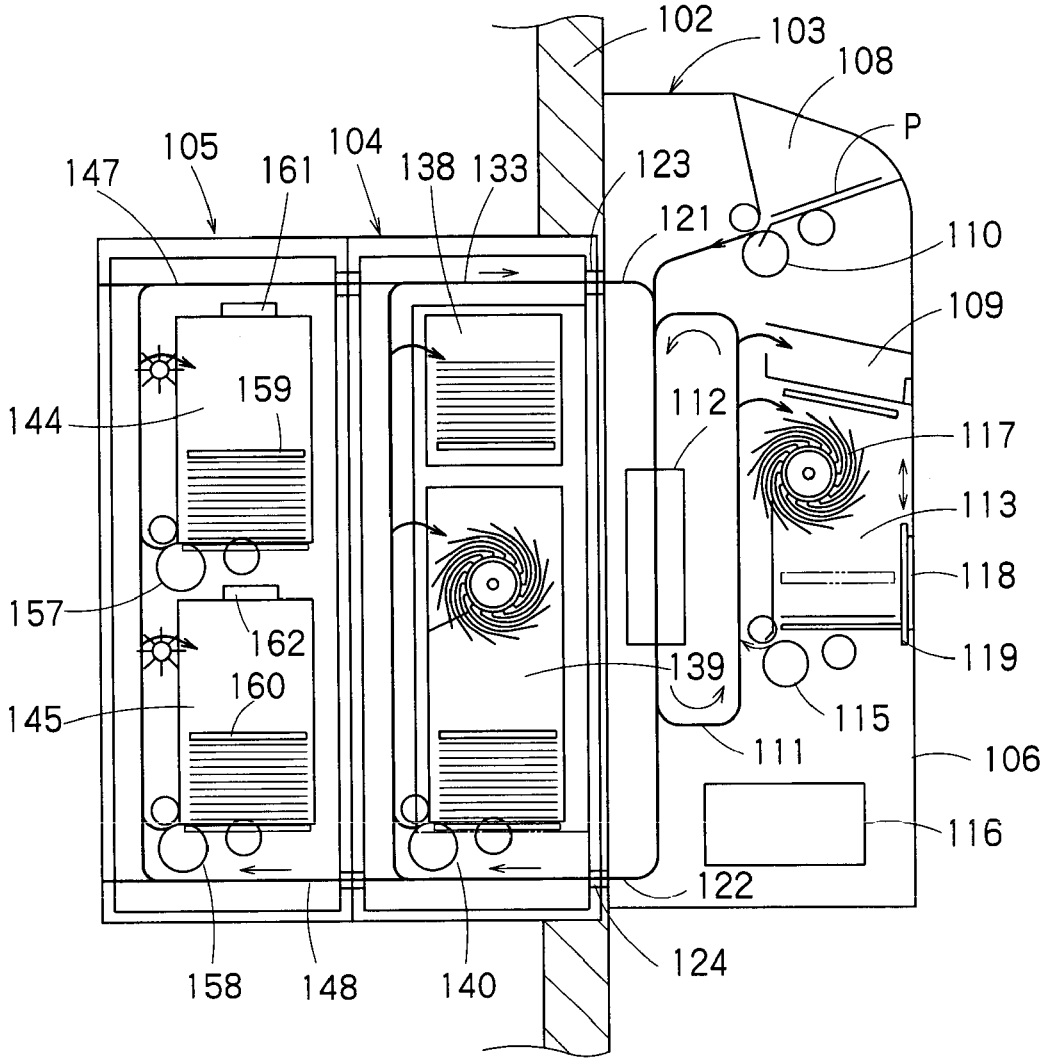
FIG. 9 is a schematic sectional view of a case wherein another bank note cassette is added to the embodiment shown in FIG. 8.
Figure 10:
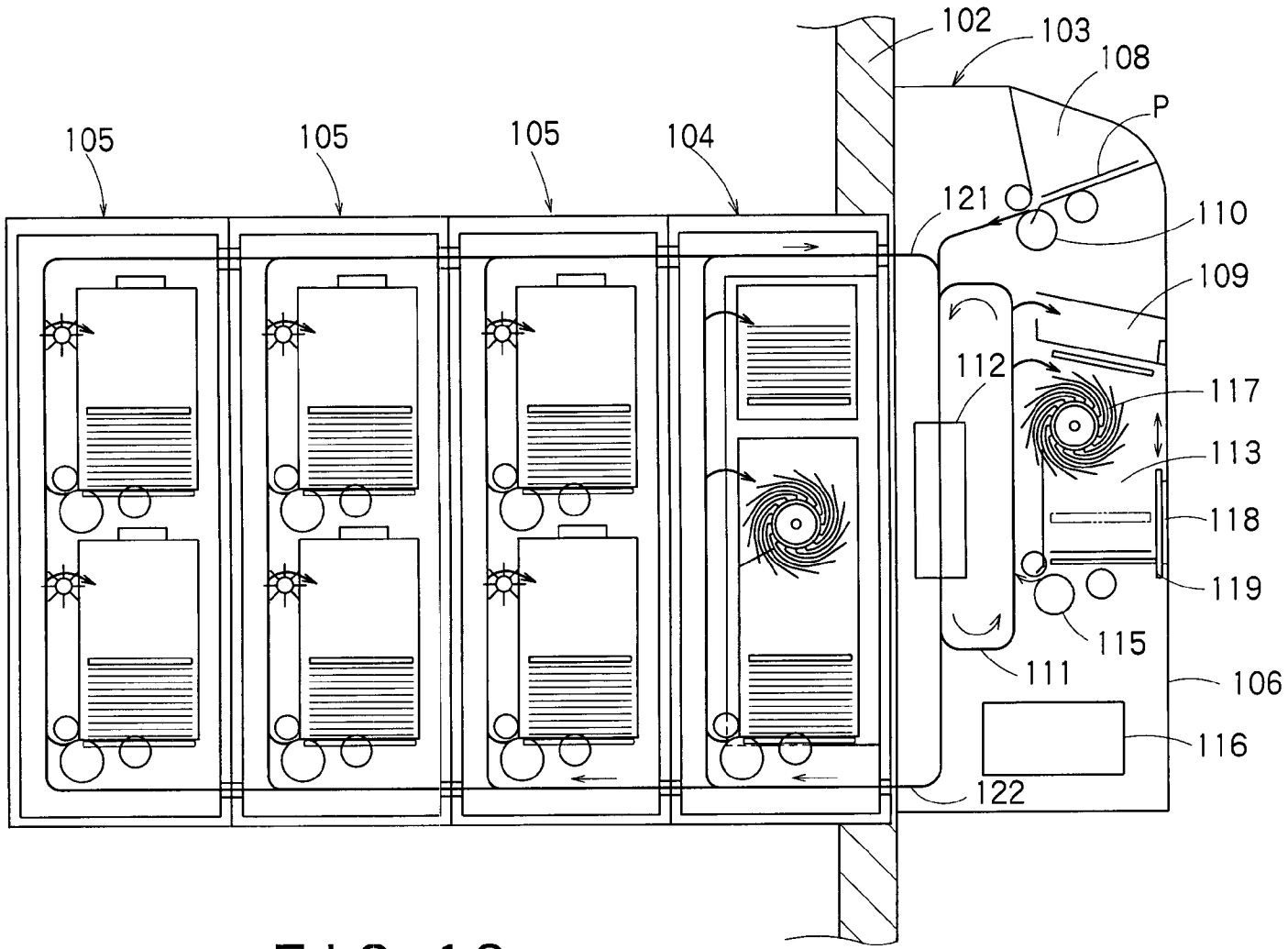
FIG. 10 is a schematic sectional view of a case wherein three bank note cassettes are added to the embodiment shown in FIG. 8.

As shown in FIGS. 8 to 10, a partition 102 separates a room 101, such as a vault, from an outside area. Only managers can enter the room 101. A bill processing unit 103 is disposed in the outside area with respect to the partition 102. A storage unit for bills P is disposed in the room 101.

As shown in FIGS. 8 to 10, the bill processing unit 103 has: a depositing portion 108 provided at a front upper portion of an outer case 106 of the bill processing unit 103, into which the bills P are inserted; a refunding (dispersing) portion 109 (rejection port) provided just below the depositing part 108 in the front surface of the outer case 106; a longitudinal looped transfer passage 111 arranged in the outer case 106 for transferring the bills that are inserted through the depositing portion 108 and fed out by a feeding mechanism 110 one by one; a discriminating (examining) component 112 arranged along the transfer passage 111 for discriminating the denomination and/or authenticating and evaluating the fitness of the bills; a temporary storing section 113 for temporarily storing the bills that have been discriminated and approved by the discriminating component 112; and a feeding mechanism 115 arranged at a lower portion of the temporary storing section 113 for feeding out the stored and approved bills P and sending them to the mixed bank note cassette 104 in the room 101. Flappers are disposed at divergence junctions between the transfer passage 111 and the respective components as usual. Operations of the respective components and the flappers are controlled by a controller 116.

In FIGS. 8 to 10, an impeller 117 is provided for smoothly accumulating the bills P transferred to the temporary storing section 113. A port 118 is provided for refunding the stored bills P when the deposit is not approved, or for paying-out the stored bills P when withdrawal is requested. A shutter 119 can open and close the port 118.

Passage portions 123, 124 including transfer passages 121, 122, respectively, branched from an upper portion and a lower portion of the transfer passage 111 are formed at an upper portion and a lower portion of a backside wall of the outer case 106, respectively. The transfer passages 121, 122 of the passage portions 123, 124 are aligned with and connect with transfer passages 133, 134 formed at an upper portion and a lower portion of the mixed bank note cassette 104, respectively.

Figure 11:
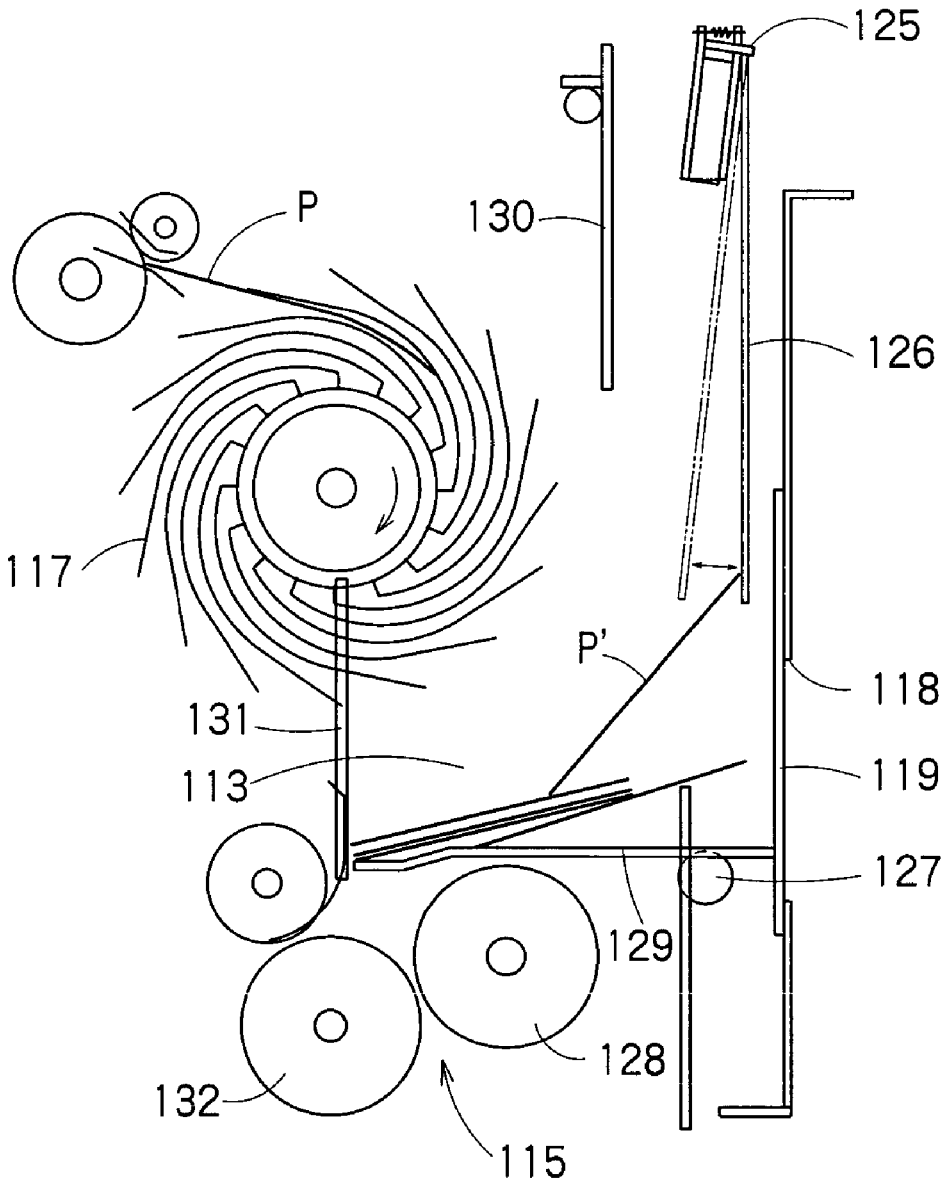
FIG. 11 is a schematic sectional view of a temporary storing part of a bill processing unit in its bill-accumulating state.

The temporary storing section 113 of the bill processing unit 103 will now be explained with reference to FIGS. 11 to 13. FIG. 11 shows the temporary storing section 113 in its bill-accumulating state, FIG. 12 shows the temporary storing section 113 in its bill-feeding state, and FIG. 13 shows the temporary storing section 113 in its bill-refunding state.

Figure 12:
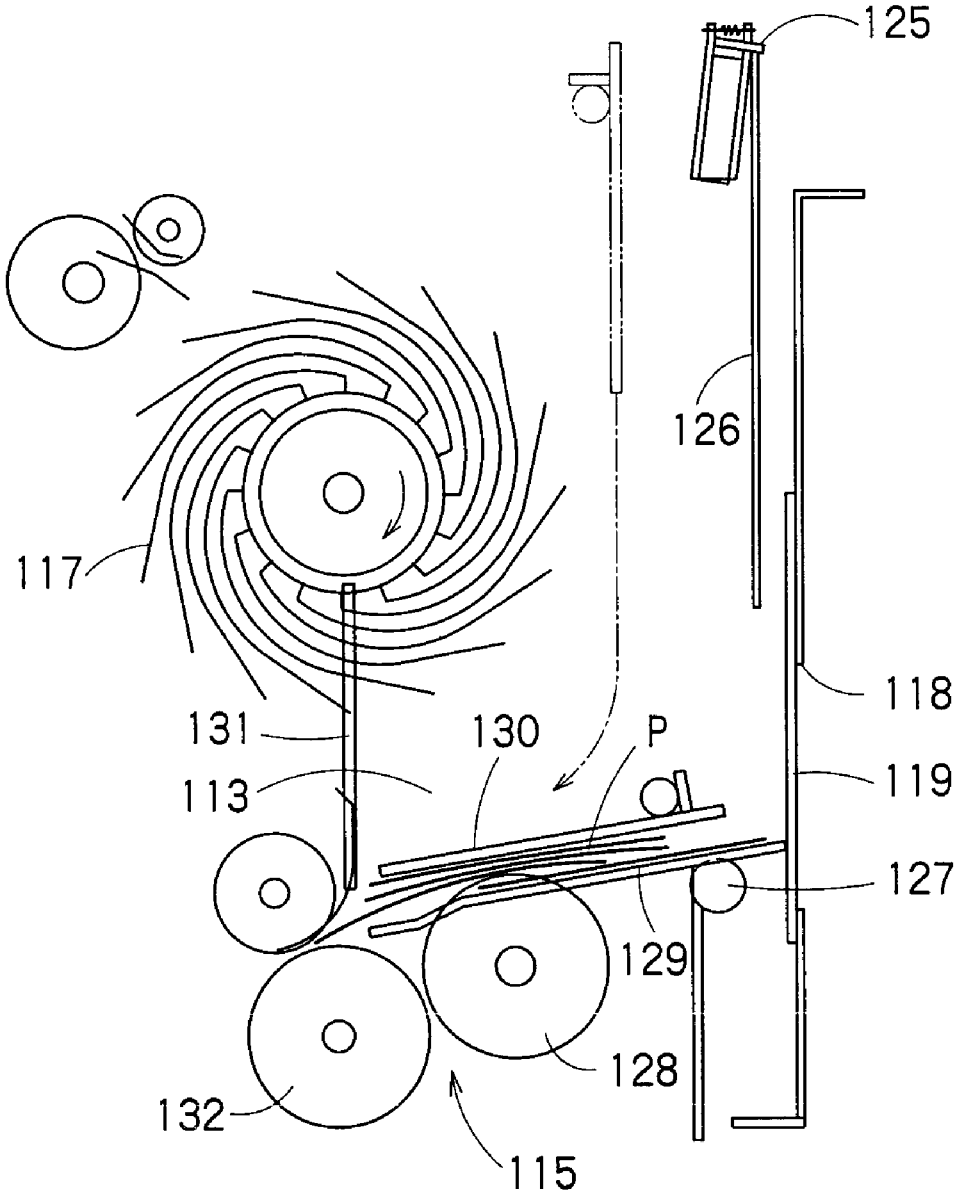
FIG. 12 is a schematic sectional view of the temporary storing part of the bill processing unit in its bill-feeding state.
Figure 13:
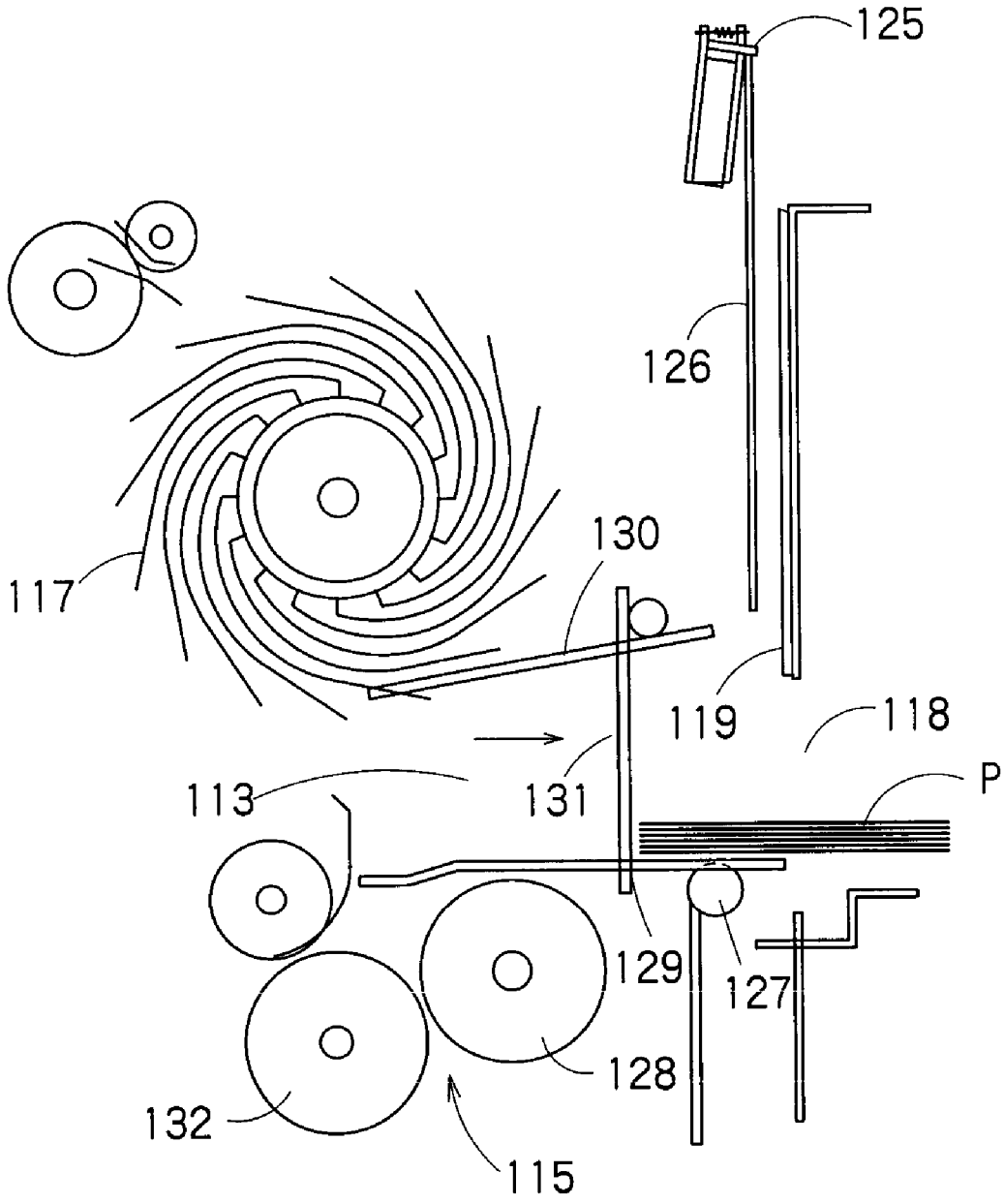
FIG. 13 is a schematic sectional view of the temporary storing part of the bill processing unit in its bill-refunding state.

As shown in FIGS. 11 to 13, a regulating plate 126 is suspended along an inside surface of the shutter 119 of the refunding (dispersing) port 118. An upper end of the regulating plate 126 is supported by a supporting part 125 in such a manner that a lower end of the regulating plate 126 reaches a vicinity of an upper end of the refunding port 118. A bill P transferred through the impeller 117 may stand up in the temporary storing part 113, which is detected by a sensor (not shown). In such a case, the regulating 10 plate 126 swings from a position shown by a real line in FIG. 11 to a position shown by a two-dotted line in FIG. 11 by a driving device such as a solenoid. Thus, the standing bill is moved into its horizontal posture. The transferred bills are accumulated on a base plate 129. The base plate 129 has a fulcrum 127 on the side of the refunding port 118. Thus, the base plate can swing from a horizontal position above a kicker-roller 128 to a position below an upper surface of the kicker-roller 128 by a driving device such as a solenoid. The kicker-roller 128 is part of a feeding-out mechanism 115. A pressing plate 130 can move down from a standing attitude shown by a real line in FIG. 11 to a substantially horizontal attitude shown by a real line in FIG. 13 by a moving mechanism (not shown). Thus, the pressing plate 130 can press down and hold the bills P accumulated on the base plate 129 when the bills P are fed out. A pushing member 131 is arranged to regulate tail ends of the bills P accumulated on the base plate 129 (see FIGS. 11 and 12). The pushing member 131 is horizontally movable from a position shown in FIGS. 11 and 12 to a forward position shown in FIG. 13 when the accumulated bills P are paid back to the refunding port 118.

Thus, the bills P to be sent to the temporary storing section 113 are received by the impeller 117 via the discriminating component 112 and the branched path. Then, the bills P are guided downward by rotation of the impeller 117 in a direction shown by an arrow in FIG. 11, and accumulated on the base plate 129 that has been horizontal. If a bill is not guided smoothly onto the base plate 129, that is, if a bill stands up like a bill P' shown in FIG. 11, the sensor (not shown) detects the situation and the regulating plate 126 swings to the position shown by the two-dotted line in FIG. 11. Thus, the standing bill P' falls down and becomes flat on the base plate 129. That is, the bill P' is also accumulated smoothly. The sensor may comprise a light-emitting element disposed at a side wall of the temporary storing section 113, a reflecting plate, such as a mirror, disposed above the refunding port 118 in the temporary storing section 113, and a light-receiving element disposed at another side wall of the temporary storing section 113. In this case, when the light-receiving element does not receive light emitted from the light-emitting element, it is thought that a bill is standing up so as to interrupt the light.

When the accumulated bills P are fed out to the mixed bank note cassette 104, as shown in FIG. 12, the base plate 129 swings down to cause a bottom surface of the lowest bill P to come in contact with the kicker-roller 128. Then, the pressing plate 130 falls down on and presses down the accumulated bills. After that, the kicker-roller 128 and a feed roller 132 are driven to feed out the bills one by one, as parts of the feeding-out mechanism 115.

When the bills P accumulated on the base plate 129 are paid back or dispensed, as shown in FIG. 13, the shutter 119 opens and the pushing member 131 moves forward. Then, the tail ends of the bills P are pushed forward so that the bills protrude through the refunding (dispersing) port 118 by substantially half their height, which is convenient to take away the bills by hand.

The mixed bank note cassette 104 has a double structure. That is, the cassette 104 has an outside (outer) shell 136 and an inside (inner) shell 137 that is fitted in the outside shell 136. The upper dispensing transfer passage 133, the lower depositing transfer passage 134 and a vertical longitudinal transfer passage 135 connecting with the transfer passages 133, 134 are arranged in the outer shell 136. An upper storage bin 138 is formed at an upper portion in the inside shell 137. A lower storage bin 139 is formed at a lower portion in the inside shell 137. A feeding mechanism 140, which can feed out the bills P from the lower storage bin 139 one by one, is arranged at a base portion of the lower storage bin 139. In addition, passages 141, 142 are branched from the vertical longitudinal passage 135 in the outside shell 136 in order to send the bills to the respective storage bins 138, 139. An impeller 143 smoothly accumulates and stores the bills P. Thus, in the mixed bank note cassette 104, the inside shell 137 can be removed from the outside shell 136. Then, only the inside shell 137 can be conveyed to an accounting office or the like.

Figure 14:
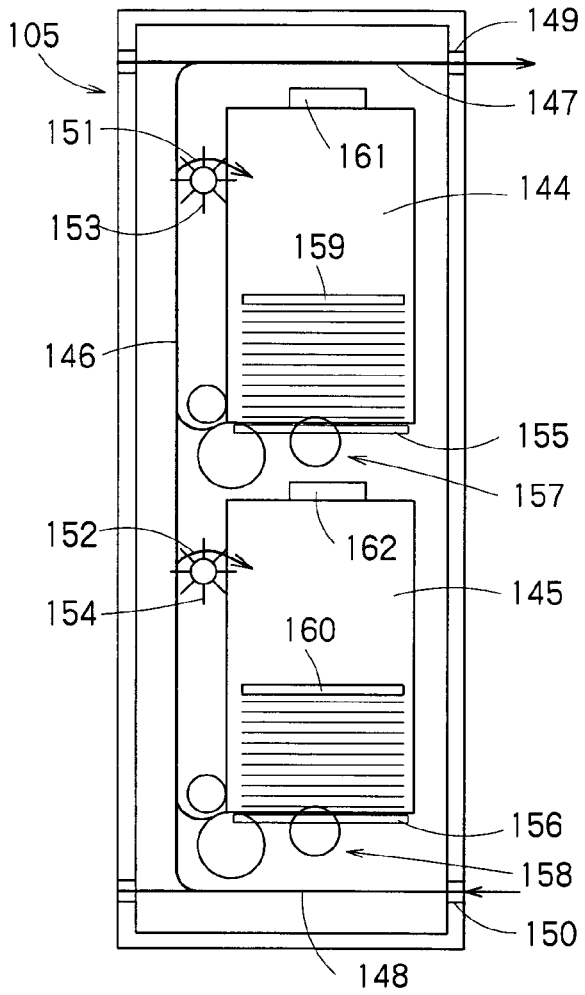
FIG. 14 is an enlarged sectional view of a bank note cassette shown in FIGS. 9 and 10.

The bank note cassettes 105 have the same structure, and FIG. 14 shows an enlarged sectional view of the structure. As shown in FIG. 14, an upper storage bin 144 is formed at an upper portion in the cassette 105. A lower storage bin 145 is formed at a lower portion in the cassette 105. The upper storage bin 144 is disposed just above the lower storage bin 145. A vertical longitudinal passage 146 is arranged along and near to a backside (left in FIG. 14) wall of the cassette 105. An upper portion and a lower portion of the transfer passage 146 are connected to an upper transfer passage 147 and a lower transfer passage 148, respectively. The upper transfer passage 147 connects with the transfer passage 133 of the mixed bank note cassette 104 via a passage portion 149 and with another upper transfer passage 147 of an adjacent (rear) bank note cassette 105. The lower transfer passage 148 connects with the transfer passage 134 of the mixed bank note cassette 104 via a passage portion 150 and with another lower transfer passage 148 of the adjacent (rear) bank note cassette 105. As shown in FIG. 10, in the rearmost (leftmost) bank note cassette 105, the upper and lower transfer passages 147 and 148 connect only with the transfer passages 147 and 148 of the right adjacent bank note cassette 105. In this case, the upper and lower transfer passages 147 and 148 in the rearmost (leftmost) bank note cassette 105 may be closed with respect to the left wall. Alternatively, the upper and lower transfer passages 147 and 148 in the rearmost (leftmost) bank note cassette 105 may be connected to transfer passages 147 and 148 of a possible left adjacent bank note cassette 105.

A branched path 151 is branched from the vertical transfer passage 146 in order to send the bills into the storage bin 144. An impeller 153 is disposed along the branched path 151 in order to send the bills more smoothly. Similarly, a branched path 152 is branched from the vertical transfer passage 146 in order to send the bills into the storage bin 145. An impeller 154 is disposed along the branched path 152 in order to send the bills more smoothly.

A receiving plate 155 (stage) is vertically movable in the storage bin 144. A feeding-out mechanism 157 that can feed out the bills from storage bin 144 one by one is arranged at a base portion of the storage bin 144. Thus, the bills are adapted to be sent to the bill processing unit 103 via the transfer passages 146 and 147. Similarly, a receiving plate 156 (stage) is vertically movable in the storage bin 145. A feeding-out mechanism 158 that can feed out the bills from storage bin 145 one by one is arranged at a base portion of the storage bin 145. Thus, the bills are adapted to be sent to the bill processing unit 103 via the transfer passages 146 and 147.

A pressing plate 159 (pressing body) that has been entirely or partly made of a magnetic material is placed in the storage bin 144. An electromagnet 161 is mounted on an upper wall of the storage bin 144. When the bills P accumulated on the receiving plate 155 are fed out, magnetic force from the electromagnet 161 stops. Then, the pressing plate 159 falls on the accumulated bills P and presses them down because of its own weight. Thus, a suitable frictional force is generated between the lowermost bill P and the feeding-out mechanism 157. On the other hand, when the bills P are received into the storage bin 144, the receiving plate 155 is once lifted up to the uppermost position, the electromagnet 161 lifts the pressing plate 159, and the receiving plate 155 is again moved down in order to allow the bills P to be sent onto the receiving plate 155.

Similarly, a pressing plate 160 (pressing body) that has been entirely or partly made of a magnetic material is placed in the storage bin 145. An electromagnet 162 is mounted on an upper wall of the storage bin 145. When the bills P accumulated on the receiving plate 156 are fed out, magnetic force from the electromagnet 162 stops. Then, the pressing plate 160 falls on the accumulated bills P and presses them down because of its own weight. Thus, a suitable frictional force is generated between the lowermost bill P and the feeding-out mechanism 158. On the other hand, when the bills P are received into the storage bin 145, the receiving plate 156 is once lifted up to the uppermost position, the electromagnet 162 lifts the pressing plate 160, and the receiving plate 156 is again moved down in order to allow the bills P to be sent onto the receiving plate 156.

Then, an operation of the fifth embodiment is explained.

When one or more bills P are deposited, the bills P to be deposited are inserted into the depositing portion 108 of the bill processing unit 103. After a predetermined depositing instruction is given, the feeding mechanism 110 operates to feed out (accept) the bills one by one. The bills are transferred through the transfer passage 111, and examined by the discriminating (examining) component 112 as to the denomination, whether the bill is true or phony, and whether the bill is fit or unfit. If a bill is judged to be a normal bill, the bill is sent to the temporary storing section 113. If a bill is judged to be unfit or counterfeit, that is, if the bill is not normal, the bill is sent back to the dispensing portion 109 (rejection port).

As shown in FIG. 8, when the storage unit is formed only by the mixed bank note cassette 104, a depositing operation is explained as described below.

At first, the bills P that have been inserted through the depositing portion 108 of the bill processing unit 103 are fed out (accepted) by feeding mechanism 110 one by one. Then, the bills P are temporarily stored by the temporary storing section 113. At that time, an amount of money of the temporarily stored bills P is shown by a tellers-machine or a separate display (not shown) as usual.

If the amount of money is approved, according to the approval instruction, the bills P in the temporary storing section 113 are fed out by the feeding-out mechanism 115 one by one. The fed bills P are transferred into the lower storage bin 139 of the mixed bank note cassette 104 through the transfer passage 111, the component 112, the transfer passage 122, and the depositing transfer passage 142. When the bills P pass through the examining component 112, the types and quantities of the bills are stored by a memory (not shown). Thus, types and quantities of the bills P received by the storage bin 139 are stored by the memory.

A dispensing operation of dispensing the bills P stored in the mixed bank note cassette 104 is explained below.

At first, the contents stored in the memory are searched to check whether bills necessary for a dispensing operation are stored or not. If the necessary number of bills is not stored, the dispensing operation can not be conducted. If the necessary number of bills is stored, the bills are fed out from the storage bin 139 by the feeding-out mechanism 140 one by one. The fed bills P are transferred to the examining component 112 through the transfer passage 135, the dispensing transfer passage 133, and the transfer passages 121 and 111.

If the examining component 112 judges that a bill is not an object to be dispensed, the bill is sent to the temporary storing section 113 of the bill processing unit 103 via the transfer passage 111. If the examining component 112 judges that a bill is an object to be dispensed, the bill is sent to the dispensing port 109.

In FIG. 9, the storage unit is formed by the mixed bank note cassette 104 and one bank note cassette 105 that is connected to the mixed bank note cassette 104. In the arrangement shown in FIG. 9, the bills can be sent to three storage bins, respectively.

In this case, each of the storage bins 144 and 145 of the bank note cassette 105 corresponds to one predetermined kind of bill to be stored therein. That is, one storage bin is adapted to store only one kind of bill. The storage bins 138 and 139 of the mixed bank note cassette 104 are adapted to be used after the storage bins 144 and/or 145 of the bank note cassette 105 become full. Alternatively, the storage bins 138 and 139 of the mixed bank note cassette 104 are adapted to be used for storing bills different than the kinds predetermined for the storage bins 144 and 145. Alternatively the storage bin 139 is used for storing normal bills that can be circulated, but the storage bin 35 138 is used for storing bills not suitable for being circulated, such as very dirty bills, very damaged bills, or bills on which tape or the like is attached. Then, the storage bin 138 may be provided with no feeding-out mechanism.

In addition, if it is necessary to increase the amount of bills and/or the kinds of bills, one or more bank note cassettes 105 are serially arranged in a column manner. The number of bank note cassettes 105 may be two, three (see FIG. 10), four, five, or any other number. If the number of bank note cassettes 105 is two, the number of storage bins may be five. If the number of bank note cassettes 105 is three, the number of storage bins may be seven. If the number of bank note cassettes 105 is four, the number of storage bins may be nine. Similarly, the number of storage bins may be freely increased.

The bills P are sent into the respective storage bins 144 and 145 of the bank note cassettes 105, through the transfer passage 146 branched from the depositing transfer passage 148, and the branched transfer passages 151 and 152.

Figures 15A, 15B, 15C:
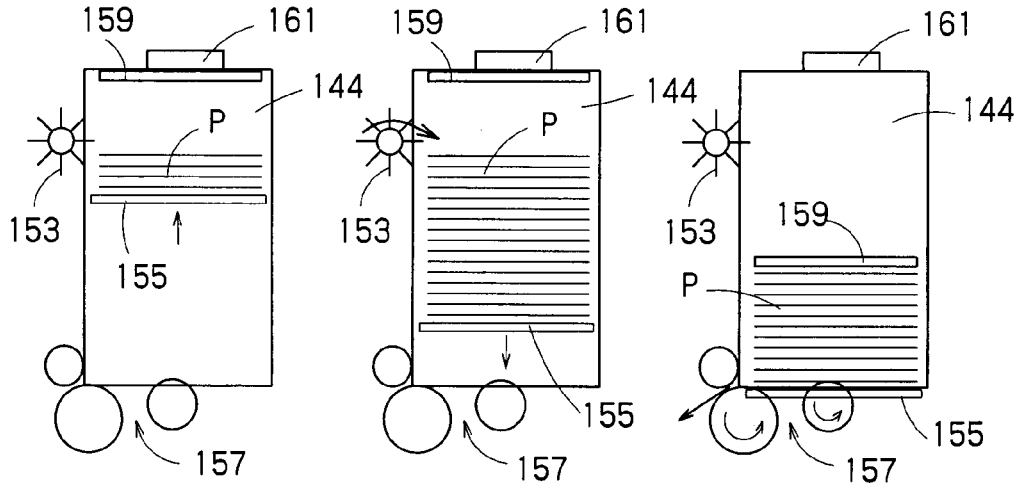
FIGS. 15A to 15C are schematic views for explaining an operation of a storage bin of the bank note cassette shown in FIG. 14.

When one or more bills P are fed out from the storage bins 144 and 145 of the bank note cassettes 105, as shown in FIGS. 15A to 15C, magnetic force from the electromagnet 161 in a state shown in FIG. 15A or FIG. 15B, wherein the storage bin stores the bills to be fed out stops. Then, the pressing plate 159 falls on the accumulated bills and presses them down because of its own weight. Then, the receiving plate 155 is moved down to the lowest position (FIG. 15C), and the lowermost bill P is pressed against the feeding-out mechanism 157 to be fed out.

The fed bills are sent to the bill processing unit 103 via the transfer passages 146 and 147, and the transfer passage 133 of the mixed bank note cassette 104. Then, the bills are examined by the examining component 112. The examined bills are sent back to the dispersing port 109, or through the temporary storing section 113. Abnormal bills that have been fed out obliquely or overlappedly may be sent to the storage bin 139 of the mixed bank note cassette 104.

Figure 16:
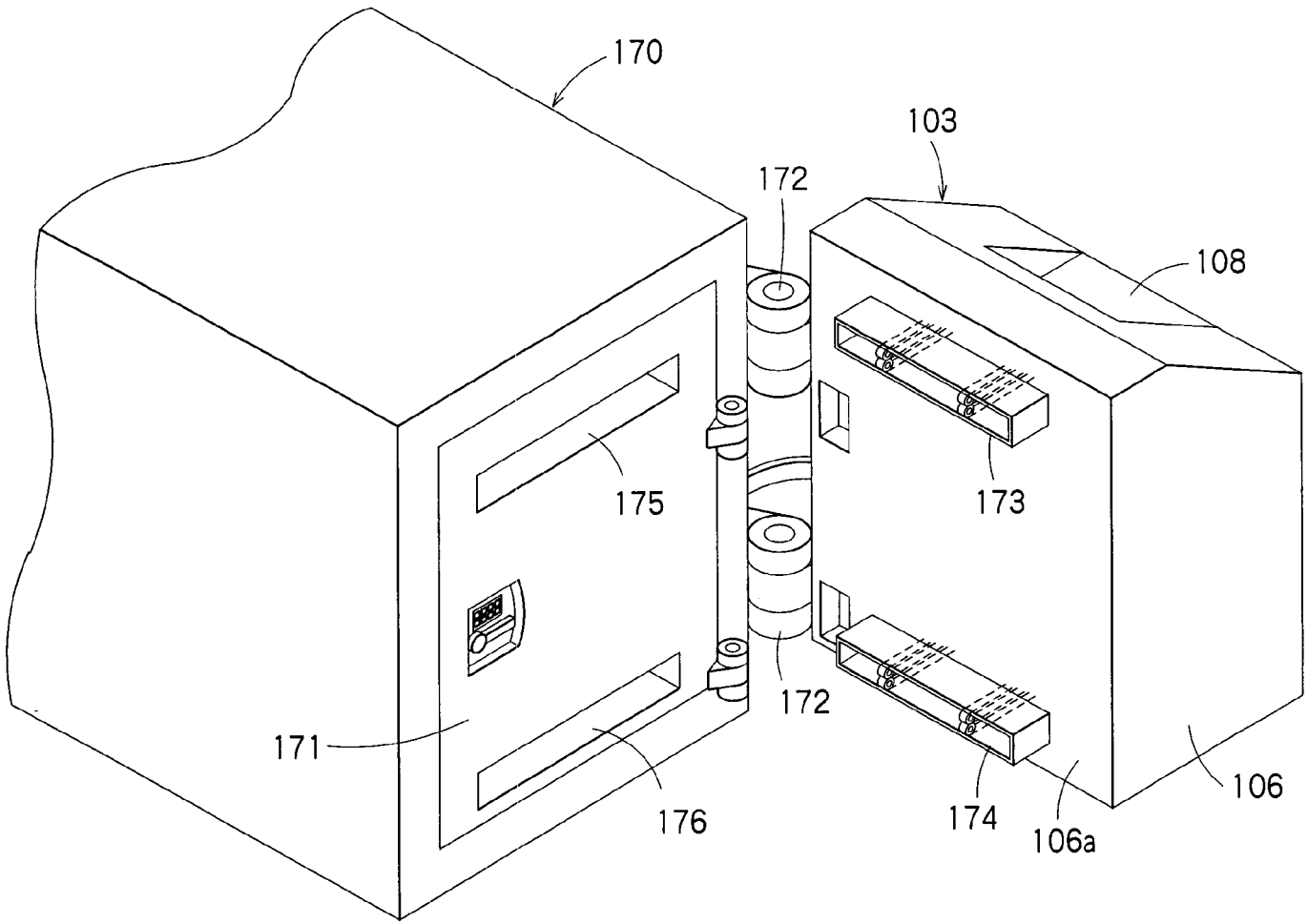
FIG. 16 is a schematic perspective view of a bill processing unit in its open state of a sixth embodiment wherein the invention is applied to a safe.
Figure 17:
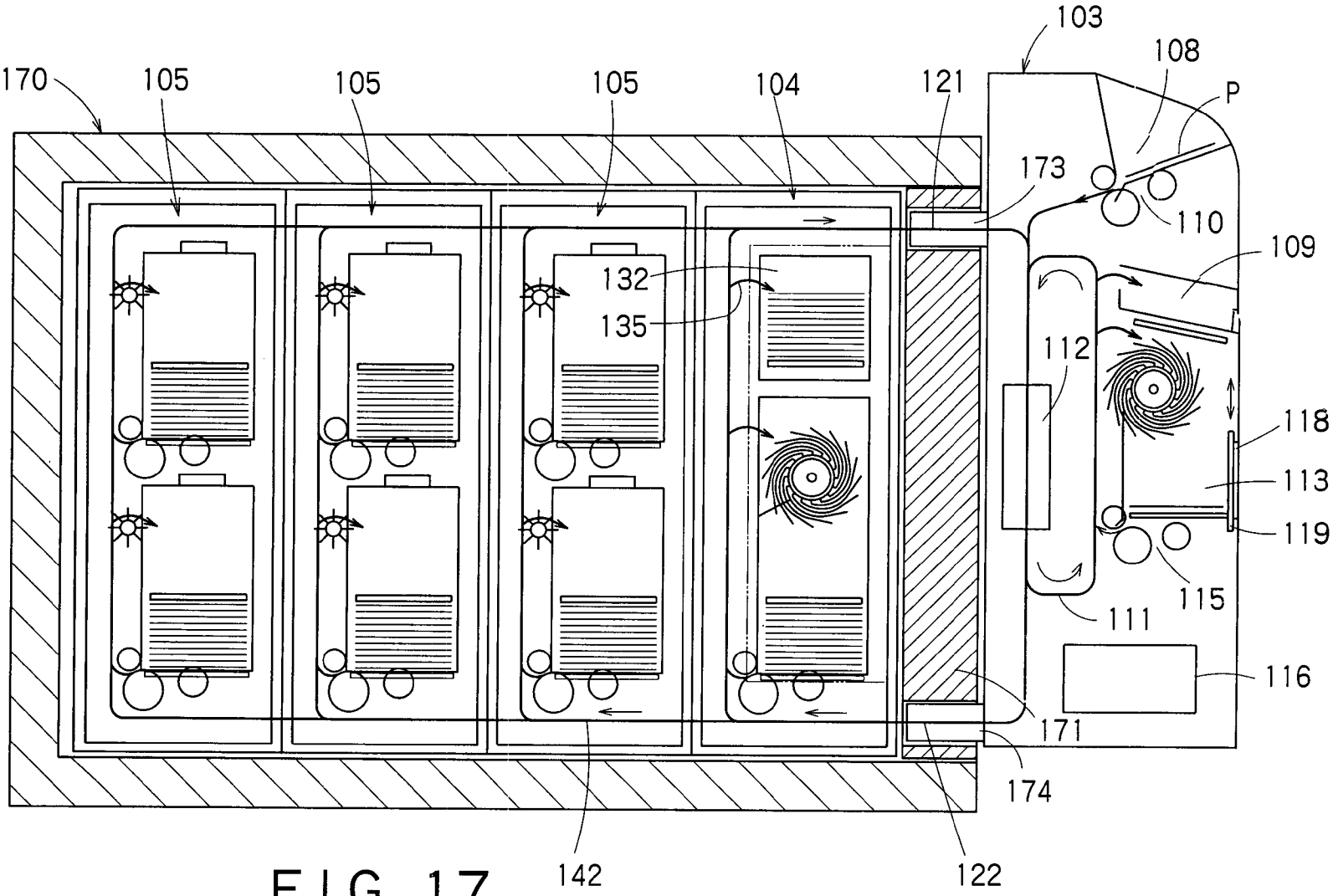
FIG. 17 is a schematic sectional view of the sixth embodiment shown in FIG. 16 in its using state.

FIGS. 16 and 17 show a sixth embodiment wherein the invention is applied to a safe. As shown in FIGS. 16 and 17, the 35 sixth embodiment mainly consists of a safe 170 and a bill processing unit 103.

In the embodiment, a door 171 is provided in a door side of the safe 170. The door 171 can open and close with respect to the door side of the safe 170. An outer case 106 defining an outer fence of the bill processing unit 103 is mounted to the door side of the safe 170 via hinges 172, 172. Thus, the outer case 106 can also open and close with respect to the door side of the safe 170. When the outer case 106 closes with respect to the door side, a backside plate 106*a* of the outer case 106 is adapted to conceal the door 171 of the safe 170. Then, the door 171 forms a partition separating the safe 170 and the bill processing unit 103.

In the safe 170, as shown in FIG. 17, a mixed bank note cassette 104 is disposed near (adjacent) to the door 171. Behind the mixed bank note cassette 104, one to several (three in FIG. 17, bank note cassettes 105 are disposed corresponding to the number of kinds of bills, in a column manner. Then, the mixed bank note cassette 104 and the bank note cassettes 105 form a storage unit.

Passage portions 173, 174 including transfer passages 121, 122, respectively, branched from an upper portion and a lower portion of the transfer passage 111 protrude from an upper portion and a lower portion of the backside plate 106*a* of the outer case 106, respectively. Each of the protruded passage portions 173, 174 has a rectangular shape having a width larger than widths of the bills. The door 171 of the safe 170 has passage openings 175, 176 into which the protruded passage portions 173, 174 can be fitted substantially tightly, respectively. That is, each of the passage openings 175, 176 also has a rectangular shape slightly larger than the protruded passage portion 173 or 174. Then, when the outer case 106 closes with respect to the door side of the safe 170, the transfer passages 121, 122 of the passage portions 173, 174 are aligned with and connect with transfer passages 133, 134 formed at an upper portion and a lower portion of the mixed bank note cassette 104, respectively.

The mixed bank note cassette 104 and the bank note cassettes 105, 105, 105 are conveyed into and from the inside of the safe 170 while the door 171 opens with respect to the door side of the safe 170. When these cassettes are set at respective predetermined positions in the safe 170, these cassettes are connected to one or more driving sources for the transfer of the bills and for operations of the respective components. For example, a driving force is transmitted from the driving sources to the components via one or more moving belts.

In the case of the above safe, the bills P are transferred substantially similarly to the embodiment shown in FIGS. 8 to 10. Thus, the same numeral references correspond to the same components as the embodiment shown in FIGS. 8 to 10. The explanation of the same structures and components is not repeated.

As described above, according to the invention, after the depositing operation, the deposited bills don't remain in the bill processing unit. In addition, the storage unit and the bill processing unit are connected with each other only via the passage opening through which the bills can pass. Thus, the bills are prevented from being stolen even if the bill processing unit is destroyed. Thus, the bill processing unit can be placed more freely, so that availability of the machine may be much improved.

In addition, according to the invention, a transferring machine including the transfer passages to the storage bin and the feeding-out mechanism from the storage bin may be provided in each bank note cassette that can be arranged serially in the columnar manner. Thus, the bill processing unit and the storage unit may be separated more completely. Thus, even if the number of bank note cassettes is increased, it is unnecessary to rebuild the transferring (driving) device.

As a result, the number of bank note cassettes may be easily increased or decreased to achieve a suitable capacity requested by users. Therefore, one machine of the invention is sufficient for different capacities, which is advantageous for reducing cost and for minimizing installation space.

In addition, the transfer passages may be formed in the bank note cassette. Thus, when a jam occurs, the transfer passages may be easily inspected by taking off the bank note cassette from the machine. That is, maintenance performance may be improved.

In addition, the electromagnet can lift and hold the pressing body provided in the storage bin, release the pressing body in such a manner that the pressing body falls on and presses down the accumulated bills for feeding out the bills, and again stick to and hold the pressing body by lifting the stage. In that case, it is unnecessary to provide any elevating mechanism for the pressing body. Thus, the structure of the storage bin is so simple that the bank note cassette is easily formed independently. Furthermore, when the removed bank note cassette is conveyed to the accounting office or the like, the electromagnet may preferably release the pressing body such that the pressing body presses the accumulated bills downward. Thus, the accumulated bills are prevented from being disturbed while the bank note cassette is conveyed.

What is claimed is:

1. A bill handling machine comprising:

a bill processing unit for receiving a bill and for examining the bill to determine whether the bill is acceptable, said bill processing unit including a temporary storage section for temporarily storing the bill received by said bill processing unit;

a storage unit for receiving and storing the bill examined and accepted by said bill processing unit; and a security barrier separating said bill processing unit from said storage unit, said partition having a passage opening for allowing the bill examined and accepted by said bill processing unit to pass through said partition.

2. A bill handling machine comprising:

a bill processing unit for receiving a bill and for examining the bill to determine whether the bill is acceptable, said bill processing unit having a bill passage;

a storage unit for receiving and storing the bill examined and accepted by said bill processing unit; and a safe having a door, said storage unit being arranged in said safe, said door of said safe separating said bill processing unit from said storage unit, said door having a passage opening for allowing the bill examined and accepted by said bill processing unit to pass through said door, said bill processing unit being arranged on said door such that said bill processing unit is operable to open and close relative to said door, such that said bill passage is aligned with said passage opening of said door when said bill processing unit is closed relative to said door, and such that said door is operable to open and close said safe when said bill processing unit is opened relative to said door.

3. A bill handling machine comprising:

a bill processing unit for receiving a bill and for examining the bill to determine whether the bill is acceptable, said bill processing unit having a bill passage and a temporary storage section for temporarily storing the bill received by said bill processing unit;

a storage unit for receiving and storing the bill examined and accepted by said bill processing unit, said storage unit having a bill passage; and a vault having a partition wall, said storage unit being arranged in said vault, said partition wall separating said bill processing unit from said storage unit, said partition wall having a passage opening for allowing the bill examined and accepted by said bill processing unit to pass through said partition wall based on an approval instruction, said bill processing unit being arranged on an outer side of said partition wall such that said bill passage of said bill processing unit and said bill passage of said storage unit are coupled via said passage opening of said partition wall.

4. A bill handling machine comprising:

a bill processing unit for receiving a bill and for examining the bill to determine whether the bill is acceptable, said bill processing unit having a bill passage and a temporary storage section for temporarily storing the bill received by said bill processing unit;

a storage unit for receiving and storing the bill examined and accepted by said bill processing unit, said storage unit having a bill passage; and a partition wall between a lobby room and a second room, said storage unit being arranged in the second room, said partition wall separating said bill processing unit from said storage unit, said partition wall having a passage opening for allowing the bill examined and accepted by said bill processing unit to pass through said partition wall based on an approval instruction, said bill processing unit being arranged on a lobby room-side of said partition wall such that said bill passage of said bill processing unit and said bill passage of said storage unit are coupled via said passage opening of said partition wall.

5. A bill handling machine comprising:

a bill processing unit operable to receive at least one bill, operable to examine each of the at least one received bill to determine whether each of the at least one received bill is acceptable, and operable to dispense the at least one received and examined bill;

a storage unit for receiving and storing the at least one bill examined and accepted by said bill processing unit, and operable to send the at least one stored bill to said bill processing unit to be dispensed by said bill processing unit; and a security barrier separating said bill processing unit from said storage unit, said partition having a passage opening for allowing the at least one bill to pass through said partition;

wherein said bill handling machine is adapted to function as a circulating-type bill depositing and dispensing unit.

6. A circulating-type bill depositing and dispensing machine comprising:

a bill processing unit operable to receive bills and operable to dispense bills;

a storage unit operable to receive and store the bills received by said bill processing unit, and operable to feed out the bills therefrom; and a storage cassette operable to receive and store the bills fed out by said storage unit, and operable to feed out the bills therefrom, said storage cassette being arranged behind said storage unit in a columnar manner, said storage cassette including:

a storage bin arranged in said storage cassette;

a depositing passage for transmitting the bills into said storage bin; and a dispensing passage for feeding out the bills from said storage bin, said depositing passage and said dispensing passage being operable to couple to a depositing passage and a dispensing passage, respectively, of an adjacent second storage cassette.

7. The machine of claim 6, wherein said storage cassette includes an outer shell and an inner shell fitted in said outer shell, said depositing passage and said dispensing passage being arranged in said outer shell, said storage bin being arranged in said inner shell, said inner shell being operable to be removed from said outer shell and transported.

8. A circulating-type bill depositing and dispensing machine comprising:

a bill processing unit operable to receive bills and operable to dispense bills;

a storage unit operable to receive and store the bills received by said bill processing unit, and operable to feed out the bills therefrom; and a storage cassette operable to receive and store the bills fed out by said storage unit, and operable to feed out the bills therefrom, said storage cassette being arranged behind said storage unit in a columnar manner, said storage cassette including a depositing passage, a dispensing passage, and two vertically-arranged storage bins, and being operable to selectively distribute each of the bills from said depositing passage to a selected one of said storage bins, and being operable to selectively feed out the bills from said storage bins to said dispensing passage.

9. A circulating-type bill depositing and dispensing machine comprising:

a bill processing unit operable to receive bills and operable to dispense bills;

a storage unit operable to receive and store the bills received by said bill processing unit, and operable to feed out the bills therefrom; and a storage cassette operable to receive and store the bills fed out by said storage unit, and operable to feed out the bills therefrom, said storage cassette being arranged behind said storage unit in a columnar manner, said storage cassette including a storage bin arranged such that the bills are fed into said storage bin through an upper portion of said storage bin and are fed out of said storage bin through a lower portion of said storage bin, said storage bin including:

a feeding-out unit at said lower portion of said storage bin, for feeding out bills from said storage bin;

stage for supporting the bills fed into said storage bin, said stage being operable to move vertically within said storage bin;

a pressing body for pressing the bills downwardly against said stage and against said feeding-out unit, said pressing body being at least partially formed of a magnetic material; and an electromagnet arranged at said upper portion of said storage bin, said electromagnet being operable to lift and hold said pressing body so as to allow the bills to be fed into said storage bin and onto said stage, and operable to release said pressing body such that said pressing body falls and presses against the bills supported by said stage.

10. A bill handling machine comprising:

a bill processing unit for receiving at least one bill and for examining the at least one bill to determine whether the at least one bill is acceptable;

a storage unit for receiving and storing the at least one bill one-at-a-time after the at least one bill is examined and accepted by said bill processing unit; and a vertical partition separating said bill processing unit from said storage unit, said vertical partition having a first passage opening for allowing the at least one bill examined and accepted by said bill processing unit to pass through said vertical partition from said bill processing unit to said storage unit, and having a second passage opening for allowing the at least one bill to pass through said vertical partition from said storage unit to said bill processing unit.

11. The machine of claim 10, wherein said bill processing unit includes a depositing portion for receiving the at least one bill deposited into said bill processing unit.

12. The machine of claim 11, wherein said bill processing unit further includes an examining component for examining the at least one bill to determine if the at least one bill is acceptable.

13. The machine of claim 12, wherein said bill processing unit further includes a returning and dispensing portion, said returning and dispensing portion being operable to return the at least one bill after the at least one bill is examined by said examining component of said bill processing unit and not accepted, and being operable to dispense the at least one bill fed into said bill processing unit from said storage unit.

14. The machine of claim 10, wherein said bill processing unit includes a returning portion for returning the at least one bill after the at least one bill is examined and not accepted by said bill processing unit.

* * * * *